United States Patent [19]

Kobori et al.

[11] Patent Number: 4,890,430

[45] Date of Patent: Jan. 2, 1990

[54] DEVICE AND METHOD FOR PROTECTING A BUILDING AGAINST EARTHQUAKE TREMORS

[75] Inventors: Takuji Kobori; Shunichi Yamada; Shuichi Kamagata, all of Tokyo, Japan

[73] Assignee: Kajima Corporation, Tokyo, Japan

[21] Appl. No.: 96,012

[22] Filed: Sep. 10, 1987

[30] Foreign Application Priority Data

| | | | |
|---|---|---|---|
| Sep. 12, 1986 | [JP] | Japan | 61-215402 |
| Sep. 19, 1986 | [JP] | Japan | 61-221143 |
| Oct. 30, 1986 | [JP] | Japan | 61-258794 |
| Oct. 30, 1986 | [JP] | Japan | 61-258795 |
| Nov. 21, 1986 | [JP] | Japan | 61-278427 |
| Dec. 17, 1986 | [JP] | Japan | 61-301036 |

[51] Int. Cl.[4] ..... E02D 27/34

[52] U.S. Cl. ..... 52/167 CB; 403/100; 403/102; 403/32

[58] Field of Search ..... 52/167, 108, 646; 403/100, 102, 32

[56] References Cited

U.S. PATENT DOCUMENTS

| | | | |
|---|---|---|---|
| 849,638 | 4/1907 | Platt | 403/102 |
| 2,352,565 | 6/1944 | Ranson | 403/102 |
| 2,965,399 | 12/1960 | Rizzuto | 403/102 |
| 3,184,261 | 5/1965 | Young | 403/102 |
| 3,796,017 | 3/1974 | Meckler | 52/167 |
| 4,389,141 | 6/1983 | Cummings | 52/167 |
| 4,429,496 | 2/1984 | Masri | 52/167 |
| 4,587,777 | 5/1986 | Vasques | 52/108 |

FOREIGN PATENT DOCUMENTS

| | | | |
|---|---|---|---|
| 3015997 | 11/1981 | Fed. Rep. of Germany | 52/118 |
| 1425887 | 3/1965 | France | 52/108 |
| 19436 | 2/1977 | Japan | 52/161 CB |
| 164520 | 8/1985 | Japan | 52/167 DF |
| 623923 | 8/1978 | U.S.S.R. | 52/167 DF |
| 838014 | 6/1981 | U.S.S.R. | 52/167 DF |
| 1030496 | 7/1983 | U.S.S.R. | 52/167 DF |
| 1328465 | 8/1987 | U.S.S.R. | 52/167 CB |

*Primary Examiner*—Henry E. Raduazo

*Attorney, Agent, or Firm*—James H. Tilberry

[57] ABSTRACT

A rigidity control device is provided to change the natural resonance of an entire building by varying the rigidity of selected structural members such as pillars, beams, braces or floor and pillar, wall and pillar or beam connection members, joints and the like. The rigidity of a structural member is controlled by restraining or releasing a member from restraint or by applying a controlled force to the member. These processes are selectively combined so that the rigidity of the whole building and each section thereof is controlled by a computer according to earthquake forecast analysis. Thus, the proper rigidity of a building is determined and provided responsive to earthquake detection to prevent the building from destructive resonance caused by earthquake tremors.

13 Claims, 24 Drawing Sheets

FIG.3(a)
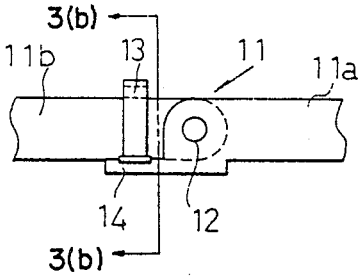
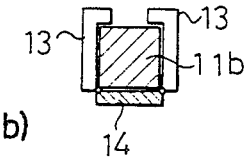
FIG.3(b)
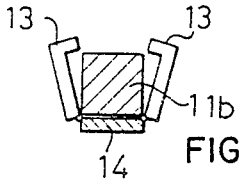
FIG.3(c)
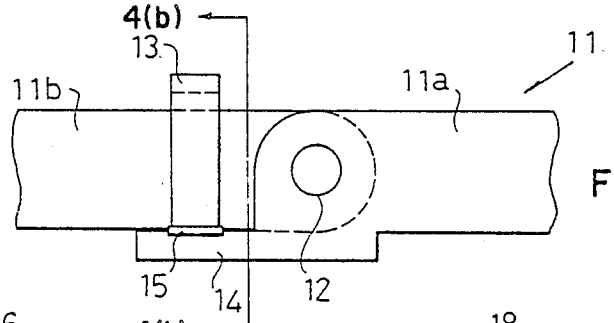
FIG.4(a)
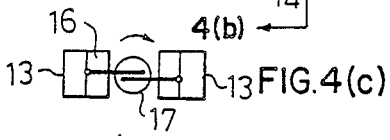
FIG.4(c)
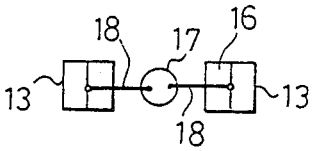
FIG.4(e)
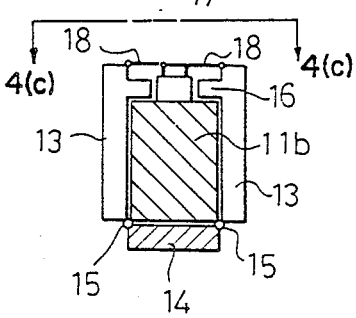
FIG.4(b)
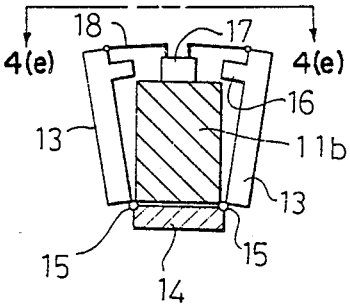
FIG.4(d)

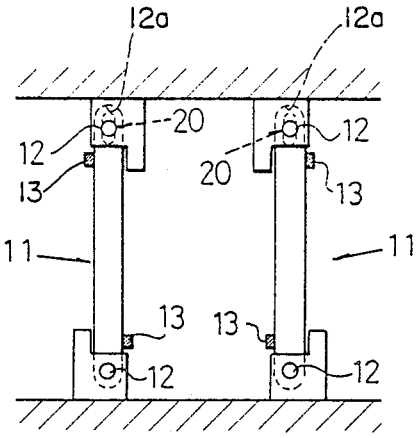
FIG.9(a)
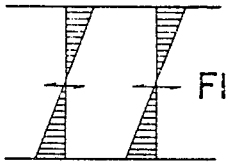
FIG.9(b)
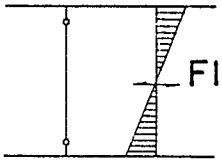
FIG.9(c)
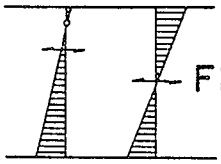
FIG.9(d)
FIG.10(a)
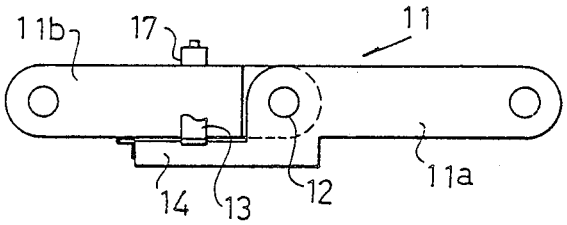
FIG.10(b)
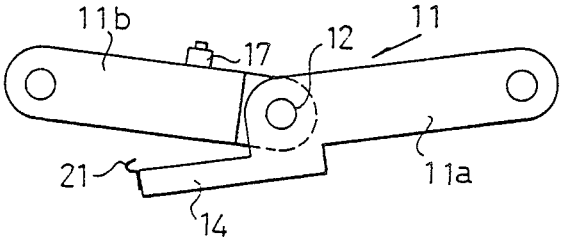
FIG.10(c)
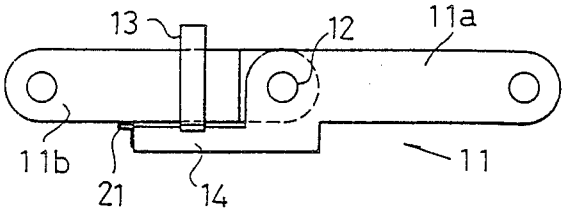

FIG. 13(a)
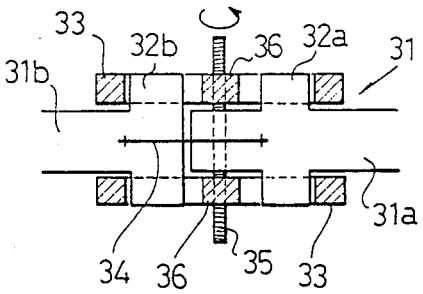
FIG. 13(b)
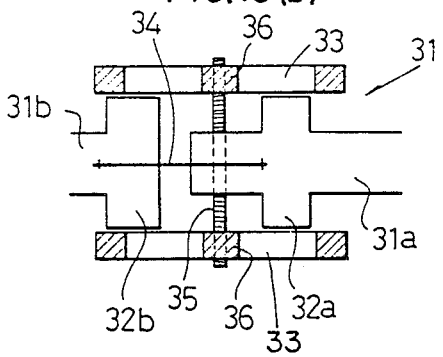
FIG. 14(a)
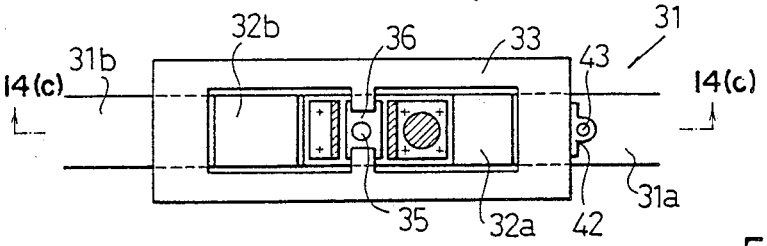
FIG. 14(b)
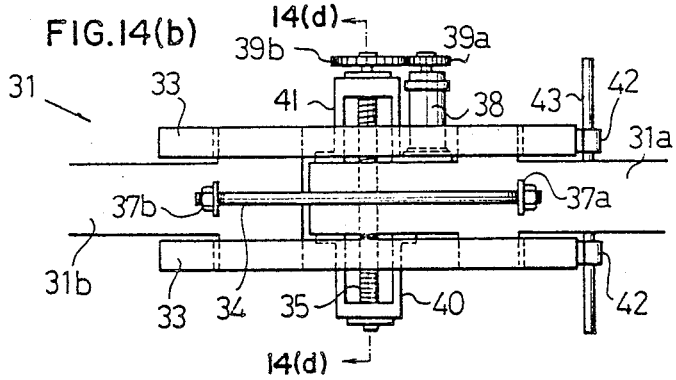
FIG. 14(d)
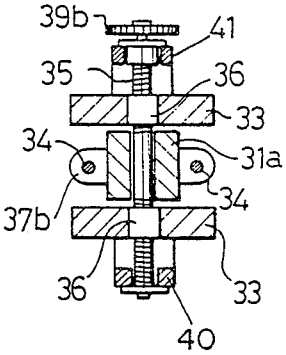
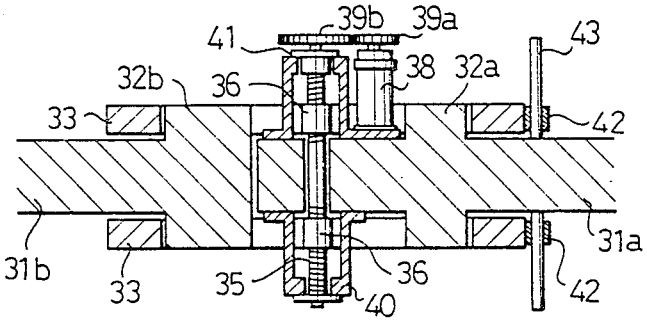
FIG. 14(c)

FIG. 15
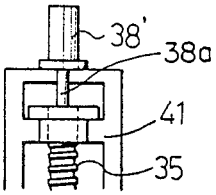
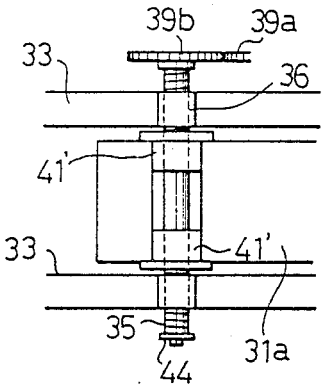
FIG. 17(a)
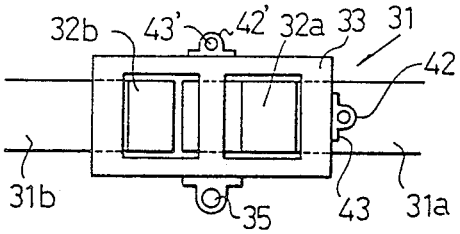
FIG. 17(b)
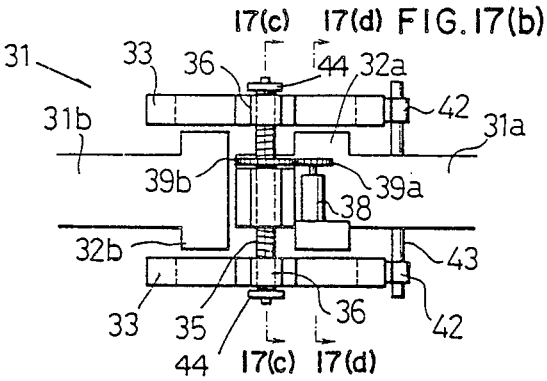
FIG. 17(c)
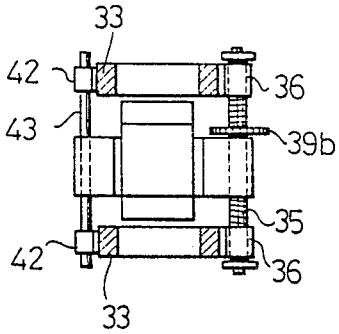
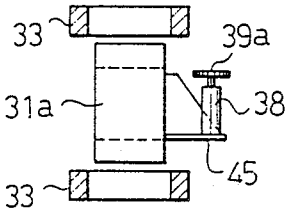
FIG. 17(d)

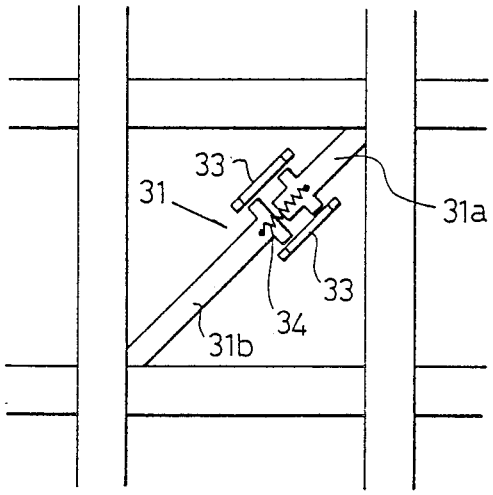
FIG. 19(a)
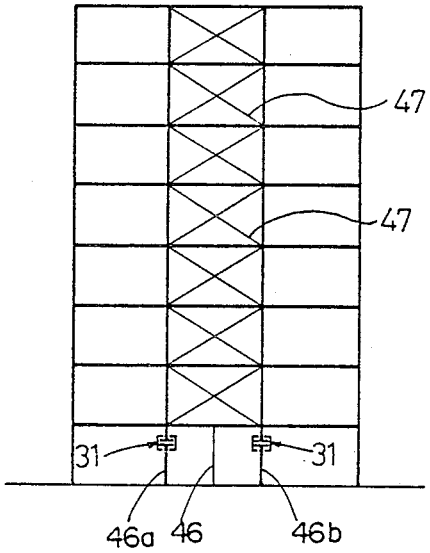
FIG. 19(b)
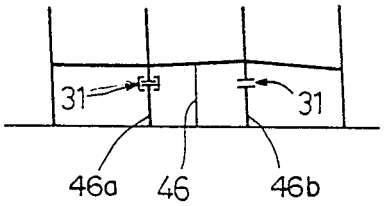

FIG. 30
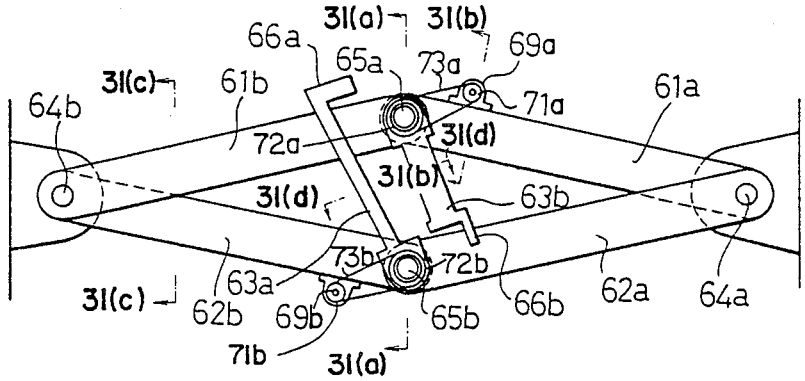
FIG. 31(a)
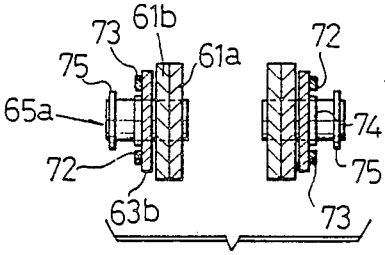
FIG. 31(b)
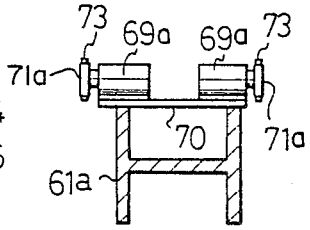
FIG. 31(c)
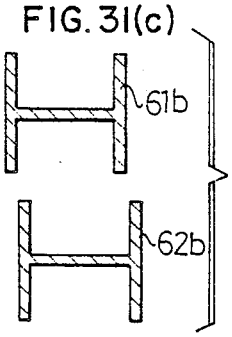
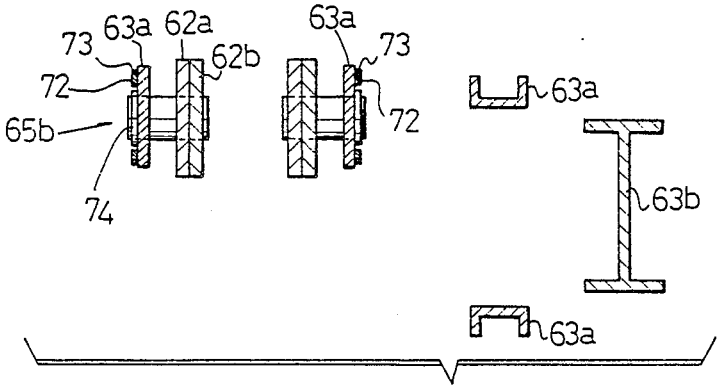
FIG. 31(d)

FIG. 41(a)
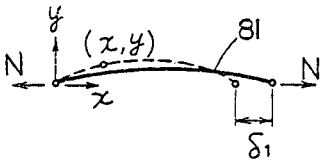
FIG. 41(b)
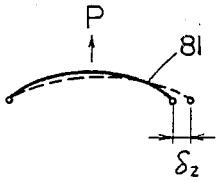
FIG. 41(c)
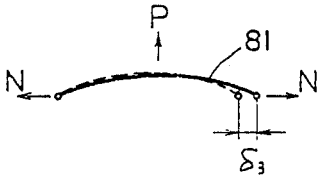
FIG. 42(a)
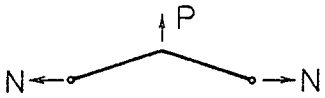
FIG. 42(b)
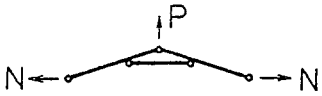
FIG. 43(a)
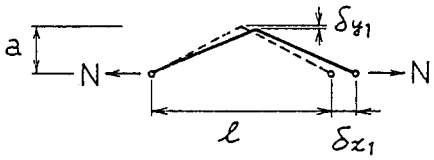
FIG. (b)
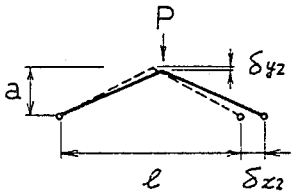
FIG. 44
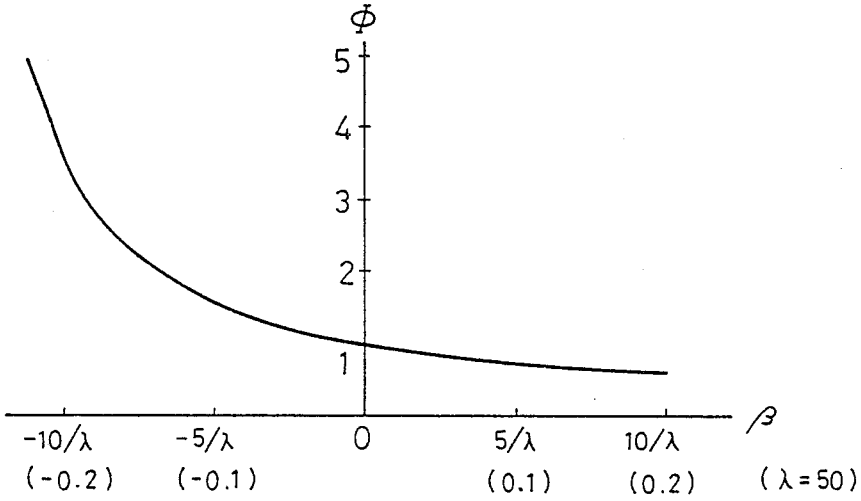

DEVICE AND METHOD FOR PROTECTING A BUILDING AGAINST EARTHQUAKE TREMORS

This invention relates in general to means to vary the rigidity of a building responsive to a forecasting system based on sensed seismic motion to vary the natural frequency of a building, thereby maintaining the structural integrity of the building, and enhancing the safety of its residents.

In particular, this invention relates to a device for varying the rigidity of a structural member of a building. The device is adaptable to maintain a structural member rigid, resistant to forces of compression, resistant to forces of tension; or selectively resistant to forces of compression and/or tension. By strategically locating these devices on key structural members of a building, the devices are adapted to be computer controlled to variably adjust the rigidity of a building to withstand destructive forces of vibration caused by earthquake tremors. The invention, in its various embodiments herein described, shall be called a "rigidity control device."

DESCRIPTION OF THE PRIOR ART

Conventionally in earthquake-proof designs of multistoried buildings, important structures or the like, the movement of a foundation and the response of a building when an earthquake occurs have been calculated to carry out a passive design to protect the building. Prior art earthquake-proofing means include the use of laminated rubber supports and dampers interposed between a building and its foundation; seismic energy absorbing building members designed to fail upon the impact of seismic stress; and building flex enhancement means provided by slits in walls, support columns, and the like.

When an earthquake occurs, the safety of buildings designed according to prior art quake resisting methods depends on the fundamental concept that the absorbing energy due to hysteresis characteristics accompanied with the plasticization of structures exceeds the seismic energy acting on the structures. However, this concept presents a problem of reliability because of hysteresis loop charac-teristics. Furthermore, conventional methods provide quake resisting structures which are passive to natural external forces such as earthquakes, wind or the like. Thus, resonance phenomena of buildings responsive to an uncertain input of earthquake forces cannot be avoided since the building has a specific natural frequency.

SUMMARY OF THE INVENTION

The present inventors propose, instead of prior art passive earthquake resisting methods, a dynamic method of controlling a building against an earthquake tremor in which the rigidity of the building itself is varied responsive to a forecasting system based on sensed seismic stresses. It is contemplated to provide an endangered building with few or no destructive resonance regions, thereby maintaining the integrity of the building, its equipment, and the safety of its residents. FIGS. 1 and 2 are respectively a schematic view and a block diagram showing the concept of the present invention. According to the inventive method of protecting a building against an earthquake, rigidity control devices are provided between pillars, beams, braces, walls and some or all of these connections and/or between the building and the foundation and/or an adjacent building to vary the structural support rigidity based on a command of a computer. The rigidity control device protects the building against an earthquake tremor in the following manner:

(1) The occurrence of an earthquake is sensed by quake sensors 3*a* and 3*b* installed in wide and narrow regions around a building 1 to transmit observed data to the computer 2 through wire and wireless communication networks. The quake sensors in the wide region are connected to seismographs placed at quake observing spots or seismographs installed exclusively through microcircuits, telephone circuits or the like. Also, the quake sensors in the narrow region consist of seismographs placed around the building or in the building foundation 6 and oscillation sensors 4 installed at the base of the building and in the building, wherein the effects of earthquake tremors, wind force or the like are sensed.

(2) The computer 2 judges the magnitude of the sensed earthquake, analyzes frequency characteristics, estimates the correct reponse, and determines whether or not the oscillation of the building should be controlled. When the oscillation is determined to be controlled, the location and the amount to be controlled are calculated to give optimum rigidity.

(3) The commands of the computer are transmitted to rigidity control devices which are placed at each section of the building and operated so that the rigidity of the building is varied to provide the optimum rigidity based on the forecast of the computer. The rigidity of the building is adjusted, for example, by turning on and off rigidity control devices by actuating means such as hydraulic mechanisms, electromagnets, and/or the introduction of selected tensile forces or special alloys.

Referring to FIGS. 1 and 2, a variable rigidity building 1 resting on a foundation 6, according to the present invention for controlling a building against earthquake stresses, comprises method and apparatus to vary the rigidity of the whole building by varying the rigidity of each critical member such as pillars, beams, braces, frames, floor members, wall members, and other member connections. This is accomplished by varying the connecting conditions of the critical members. The present invention, however, is not limited only to the use of the method of controlling the building against an earthquake, but also may be used to control the rigidity of a building for any purpose.

The rigidity of the critical members may be varied, for example, by using members constituted from a plurality of parts to give the variation between the basic rigidity and zero rigidity or several discontinuous stages of change in the rigidity by the restraint between respective parts and release of the restraint by applying computer-controlled force to a member which is capable of varying the rigidity of the member on demand. These members are properly combined in the building for computer control of the rigidity of the whole building and its respective sections during an occurring earthquake, thereby preventing the building from destructively resonating responsive to earthquake-induced vibrations.

Other objects and features of the present invention will become apparent from the following description of preferred embodiments of the invention with reference to the accompanying drawings.

FIRST EMBODIMENT—FIGS. 3-12

Figure 5:
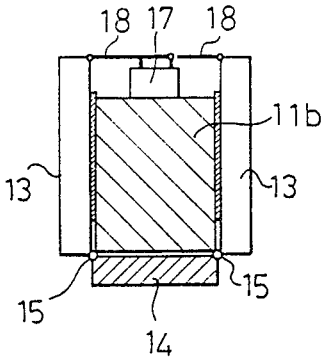
Figure 6:
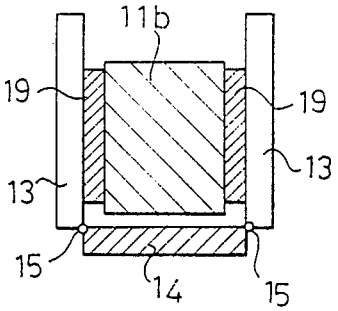
Figure 7A:
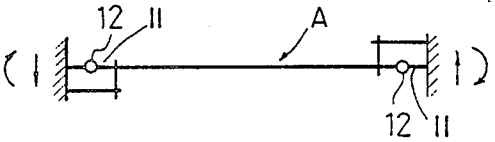
Figure 7B:
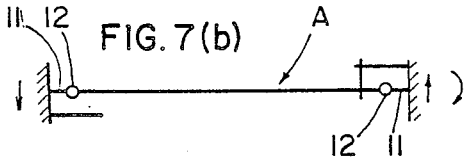
Figure 7C:
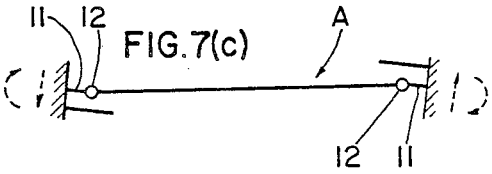
Figure 8A:
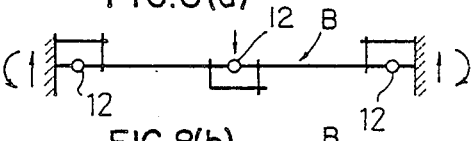
Figure 8B:
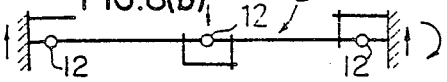
Figure 8C:
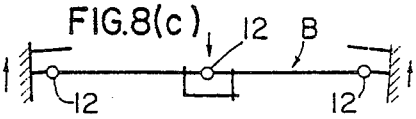
Figure 8D:
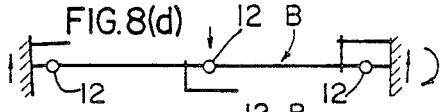
Figure 8E:
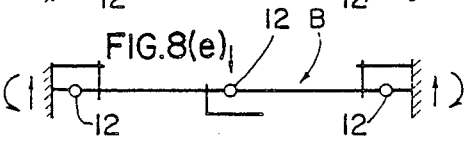
Figure 8F:
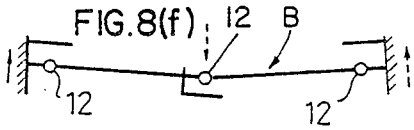
Figure 11:
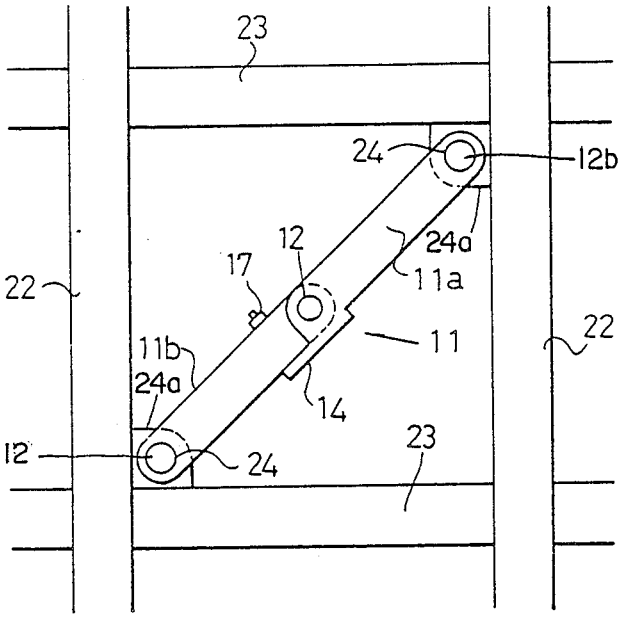
Figure 12A:
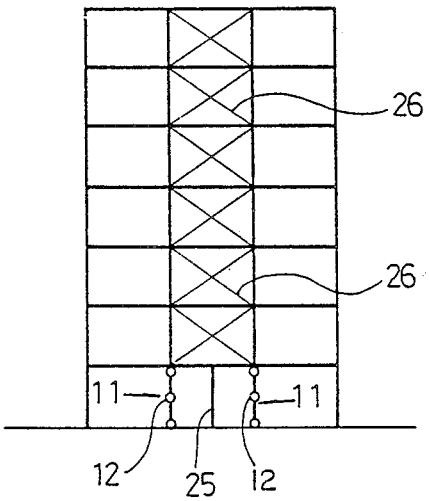
Figure 12B:
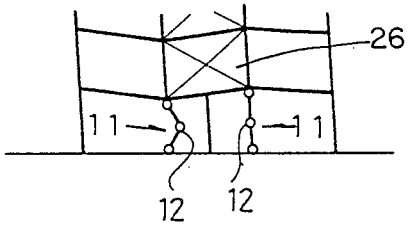

FIG. 3(*a*) is a fragmentary elevational view of a rigidity control device employed in a first preferred embodiment of the invention;

FIG. 3(*b*) is a sectional view of the rigidity control device of FIG. 3(*a*) taken on the line 3(*b*)—3(*b*) of FIG. 3(*a*);

FIG. 3(*c*) is a modified sectional view of the rigidity control device of FIG. 3(*a*) shown in the restraint released condition:

FIG. 4(*a*) is a modified rigidity control device similar to FIG. 3(*a*);

FIG. 4(*b*) is a sectional view of the rigidity control device of FIG. 4(*a*) taken on the line 4(*b*)—4(*b*) of FIG. 4(*a*);

FIG. 4(*c*) is a schematic top plan view of the rigidity control device taken on the line 4(*c*)—4(*c*) of FIG. 4(*b*);

FIG. 4(*d*) is a modified sectional view of the rigidity control device of FIG. 4(*a*) shown in the restraint released condition;

FIG. 4(*e*) is a schematic top plan view of the rigidity control device taken on the line 4(*e*)—4(*e*) of FIG. 4(*d*);

FIG. 5 is a sectional view of rigidity control device showing a modified restraining means;

FIG. 6 is a sectional view of a rigidity control device showing another modified restraining means;

FIGS. 7(*a*), 7(*b*) and 7(*c*) are schematic sketches showing the invention reacting to stress in a structural member;

FIGS. 8(*a*) to 8(*f*) are also schematic sketches showing the invention exposed to dynamic stress conditions of a structure;

FIG. 9(*a*) is an elevational front view of a load supporting pillar protected by one embodiment of the invention;

FIGS. 9(*b*) to 9(*d*) are bending moment diagrams;

FIGS. 10(*a*) to 10(*c*) are front elevational views showing a three-pin rigidity control device;

FIG. 11 is a front elevational view showing an application of a three-pin rigidity control device;

FIG. 12(*a*) is a schematic elevational sketch of a building provided with rigidity control-protected pillars;

FIG. 12(*b*) is a schematic partial elevational sketch of the building shown in FIG. 12(*a*) in which one of the pillars has yielded to a bending force in accordance with the invention;

SECOND EMBODIMENT—FIGS. 13-22

Figure 20:
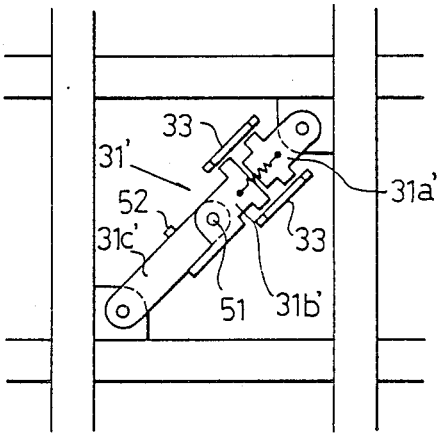
Figure 21:
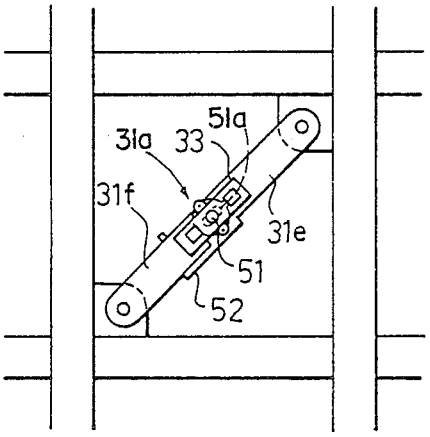
Figure 22A:
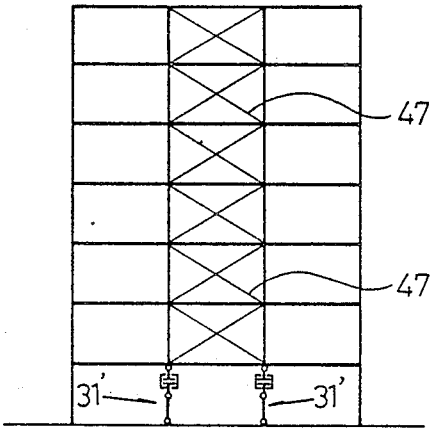
Figure 22B:
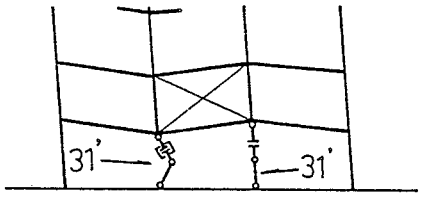

FIGS. 13(*a*) and 13(*b*) are elevational views, partially in section, showing the basic structure of a second embodiment of the invention under the restrained condition and under the restrain released condition respectively;

FIG. 14(*a*) is a top plan view, partially in section, of another embodiment of the invention;

FIG. 14(*b*) is a front elevational view of the device shown in FIG. 14(*a*);

FIG. 14(*c*) is an elevational view in section taken along the line 14(*c*)—14(*c*) of FIG. 14(*a*);

FIG. 14(*d*) is an elevational view in section taken along the line 14(*d*)—14(*d*) of FIG. 14(*b*);

FIGS. 15 and 16 are fragmentary elevational views of modified drive mechanisms;

FIG. 17(*a*) is a top plan view of a modified version of the second embodiment of the invention;

FIG. 17(*b*) is a front elevational view of the device shown in FIG. 17(*a*);

FIG. 17(*c*) is a side elevational view, partially sectioned, of the device shown in FIG. 17(*a*);

FIG. 17(*d*) is an exploded elevational view of several basic elements of the device shown in FIG. 17(*a*);

FIG. 18 is a front elevational view showing the inventive device applied to a cross brace of a structure;

FIGS. 19(*a*) and 19(*b*) are front elevational views of a building wherein inventive devices are applied to pillars disposed at the lower end of the building;

FIGS. 20 and 21 are front elevational views of a modified version of the inventive device applied to a cross brace of a building;

FIGS. 22(*a*) and 22(*b*) are front elevational views of a building showing rigidity control devices applied to pillars of the building;

THIRD EMBODIMENT—FIGS. 23-36

Figure 24:
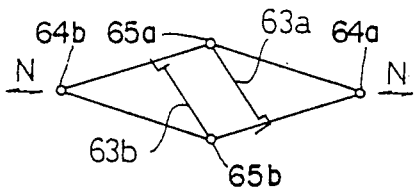
Figure 24B:
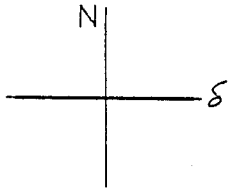
Figure 23A:
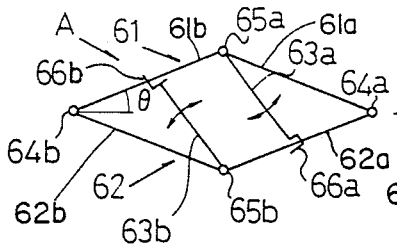
Figure 23B:
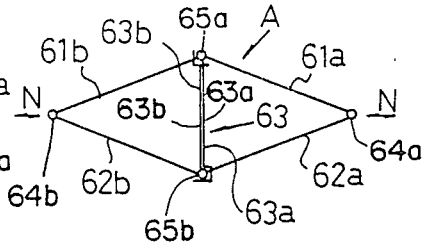
Figure 29A:
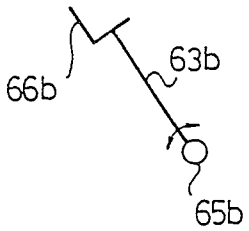
Figure 29B:
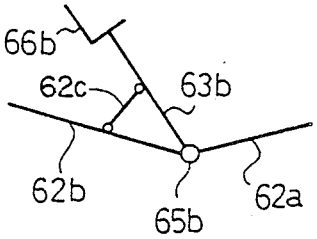
Figure 32:
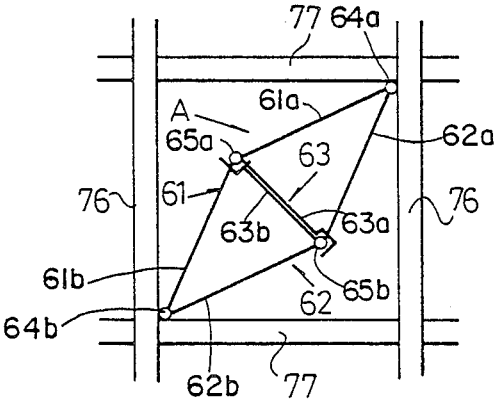
Figure 33:
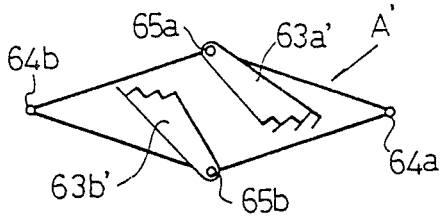
Figure 34A:
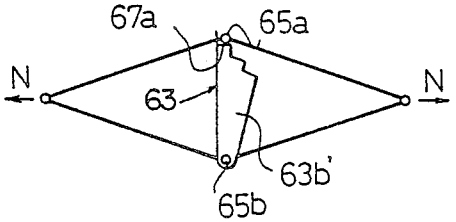
Figure 34D:
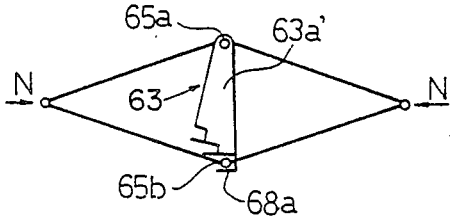
Figure 34B:
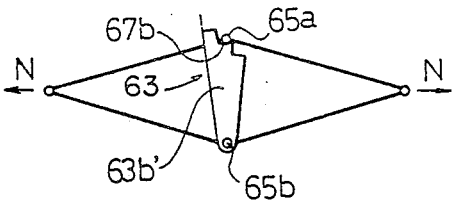
Figure 34E:
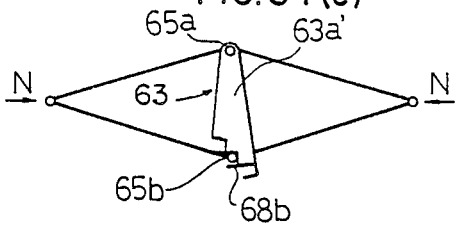
Figure 34C:
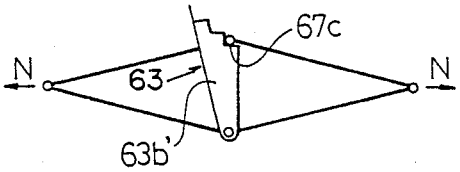
Figure 34F:
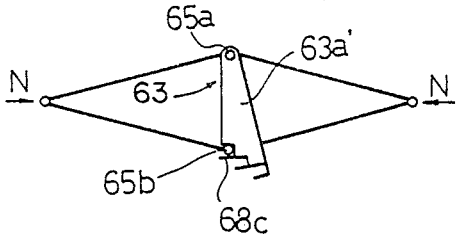
Figure 35:
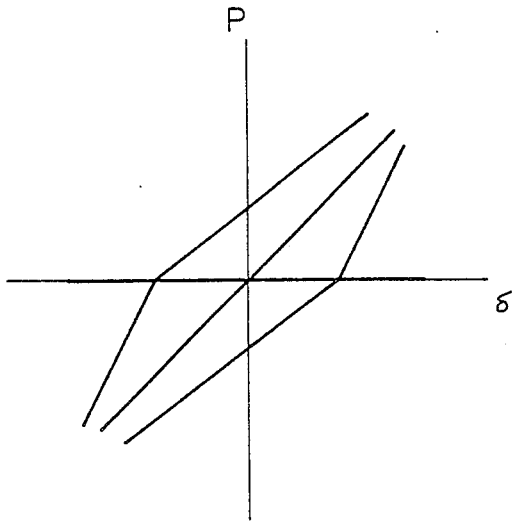
Figure 36:
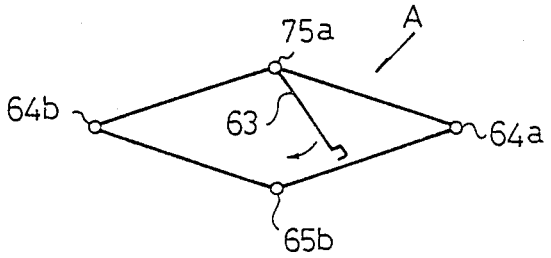

FIGS. 23 (*a*) and 23(*b*) are schematic diagrams showing the basic structure of a third embodiment of the invention;

FIGS. 24(*a*), 25(*a*), 26(*a*), 27(*a*), 29(*a*), and 29(*b*) are schematic diagrams of the invention shown under different stress conditions;

FIGS. 24(*b*), 25(*b*) 26(*b*), 27(*b*) and 28 are force diagrams showing the relationship between force and displacement of the inventive device;

FIGS. 29(*a*) and 29(*b*) are front schematic views showing a method of operating connecting members;

FIG. 30 is a front elevational view of the inventive device shown schematically in FIGS. 24-27:

FIGS. 31(*a*) to 31(*d*) are respectively end views in section taken along the lines 31(*a*)—31(*a*); 31(*b*)—31(*b*); 31(*c*)—31(*c*); and 31(*d*)—31(*d*) of FIG. 30;

FIG. 32 is a schematic elevational view showing the inventive device applied to a cross brace of a structure;

FIG. 33 is a schematic elevational view wherein the inventive device is adapted to vary resistance to force in a plurality of stages;

FIGS. 34(*a*) to 34(*f*) are schematic elevational views showing the inventive device in various conditions of resistance;

FIG. 35 is a force diagram showing the relationship between force and displacement with the use of the inventive device shown in FIG. 33;

FIG. 36 is a schematic elevational view showing the inventive device with a single connecting member usable for both tension and compression;

FOURTH EMBODIMENT—FIGS. 37-48

Figure 37:
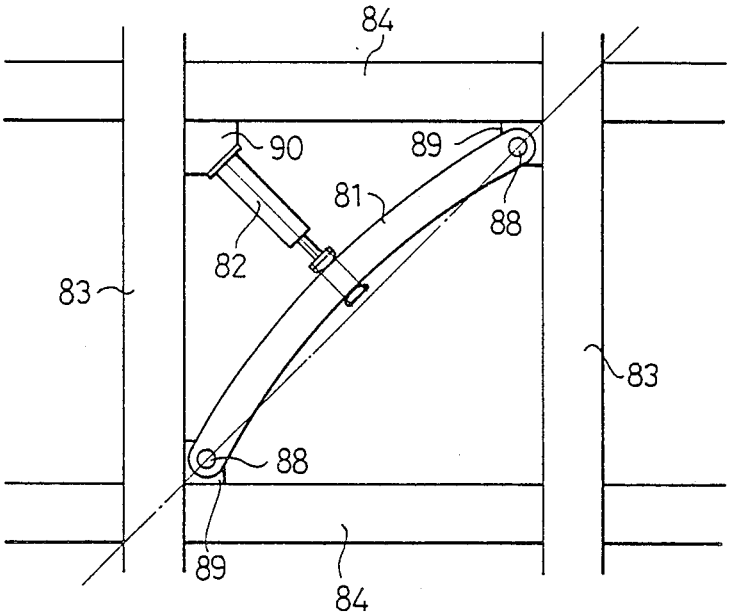
Figure 38:
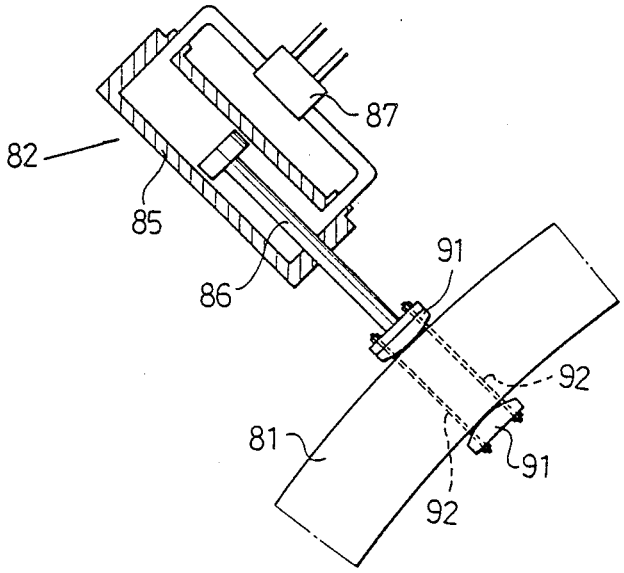
Figure 39:
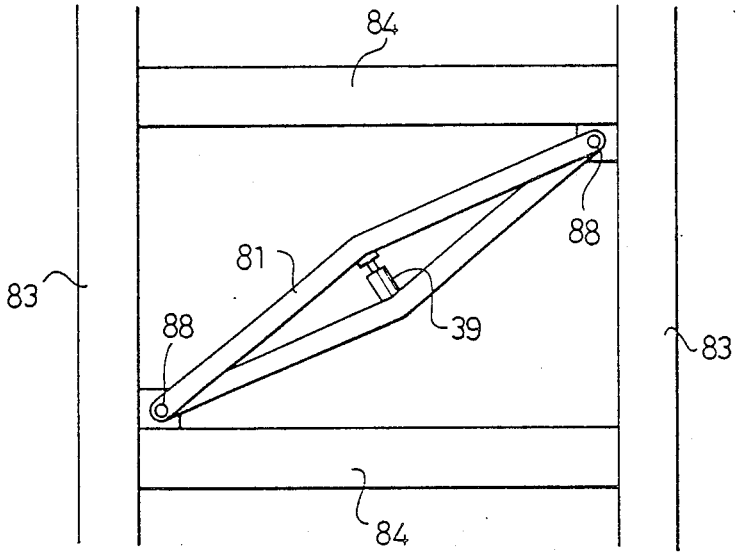
Figure 40:
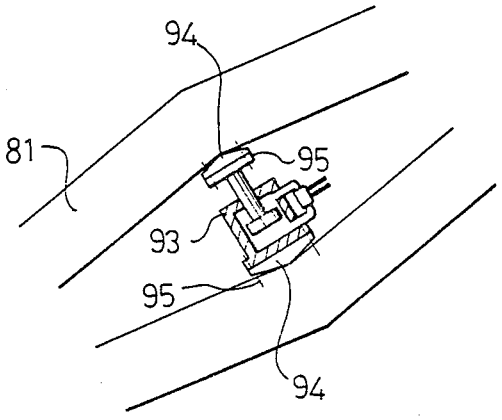
Figure 45:
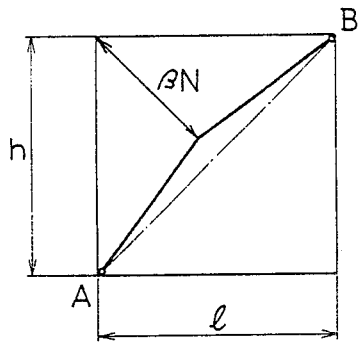
Figure 46:
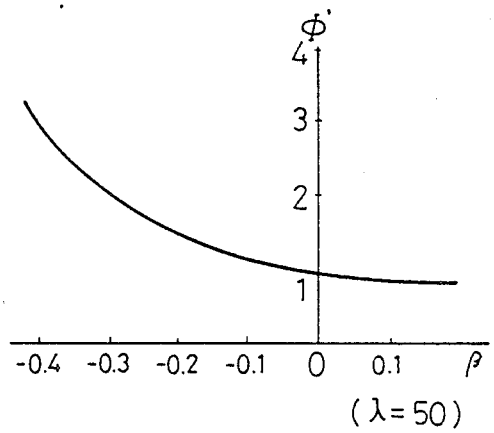
Figure 47:
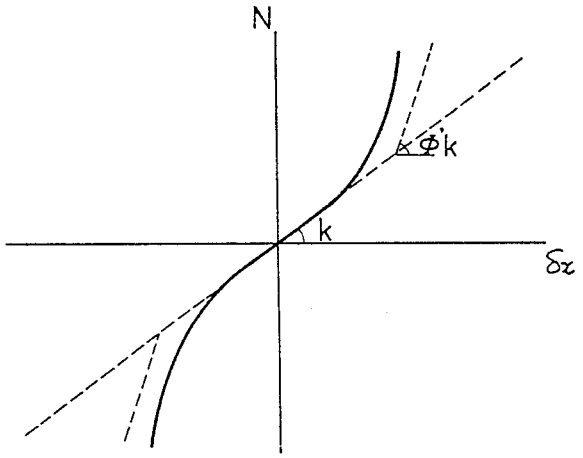
Figure 48A:
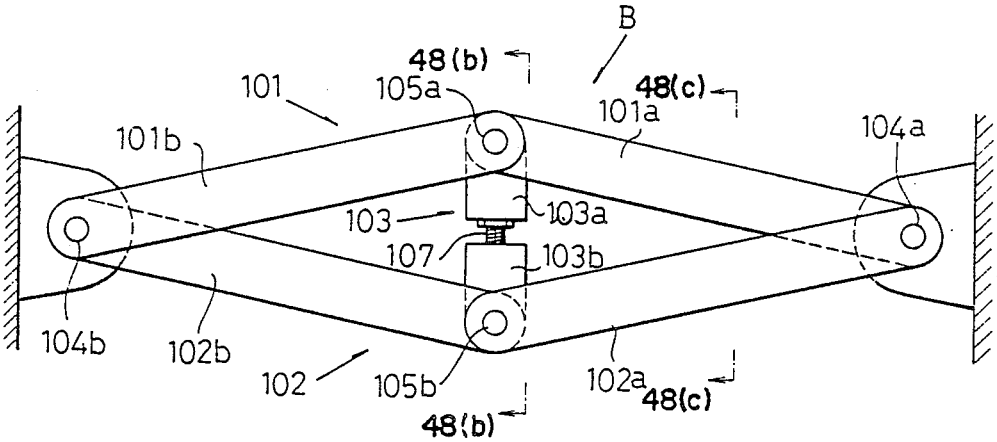
Figure 48B:
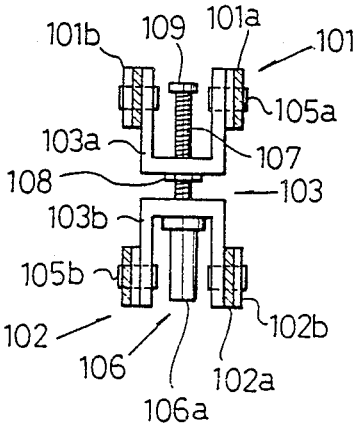
Figure 48C:
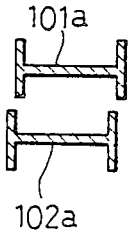
Figure 48D:
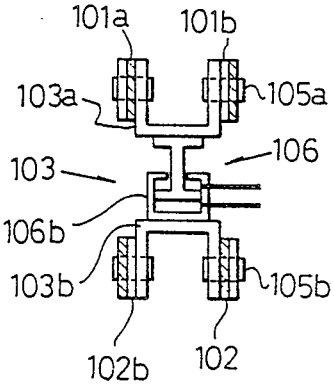

FIG. 37 is a front elevational view showing a fourth embodiment of the inventive device;

FIG. 38 is a sectional view showing a drive unit for use with the inventive device of FIG. 37;

FIG. 39 is a front elevational view showing a modification of the fourth embodiment of the invention;

FIG. 40 is a sectional view showing a modified drive unit of the device shown in FIG. 39;

FIGS. 41(*a*), 41(*b*), 41(*c*), 42(*a*), 42(*b*), 43(*a*), and 43(*b*) are schematic sketches to illustrate the principle underlying the present invention;

FIG. 44 is a graph showing the rate of change in structural rigidity;

FIG. 45 is a simplified schematic sketch showing force applied to a brace;

FIG. 46 is a graph showing the rate of change in rigidity of a structural member;

FIG. 47 is a force diagram showing the relationship between the axial force and the displacement of a structural member;

FIGS. 48(*a*) to 48(*d*) illustrate another modification of the fourth embodiment of the invention, wherein:

FIG. 48(*a*) is a front elevational view of the device;

FIG. 48(*b*) is an elevational view, partially sectioned, taken along the line 48(*b*)—48(*b*) of FIG. 48(*a*);

FIG. 48(*c*) is an elevational view in section taken along the line 48(*c*)—48(*c*) of FIG. 48(*a*); and FIG. 48(*d*) is an elevational view, partially sectioned, similar to FIG. 48(*b*), but with a modified drive means;

FIFTH EMBODIMENT—FIGS. 49–53

Figure 49:
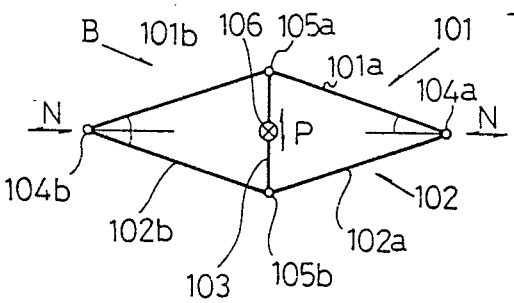
Figure 50A:
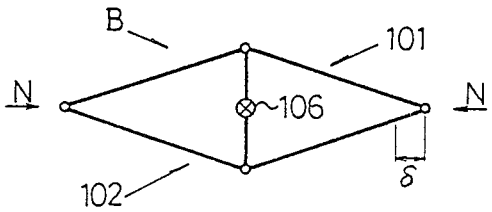
Figure 50B:
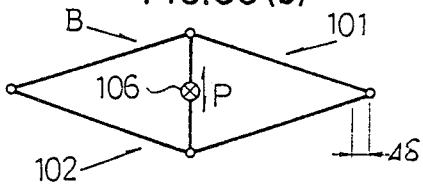
Figure 51:
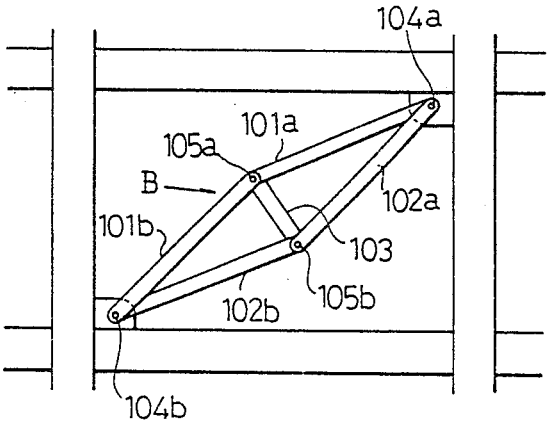
Figure 52:
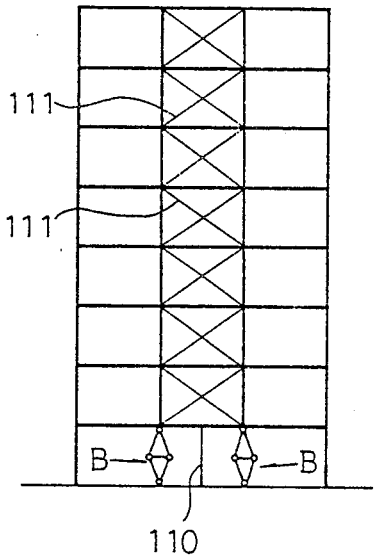
Figure 53:
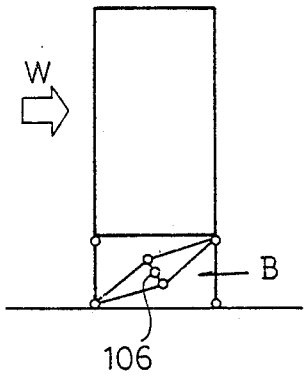
Figure 53:
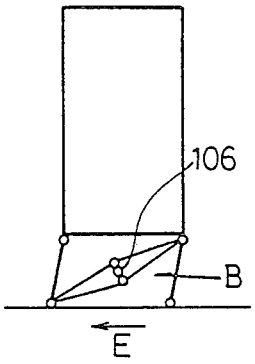
Figure 53:
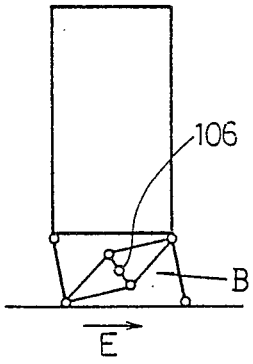

FIG. 49 is a schematic sketch illustrating a fifth embodiment of the invention;

FIGS. 50(*a*) and 50(*b*) are schematic sketches further illustrating the fifth embodiment of the invention;

FIG. 51 is a front view showing an example of the fifth embodiment of the invention applied to a structural brace;

FIG. 52 is a schematic front elevational sketch of a building structure showing an inventive device applied to moment resisting pillars;

FIGS. 53(*a*) to 53(*c*) are schematic elevational sketches showing the inventive device applied to a structural brace at the lowest level of the building;

SIXTH EMBODIMENT—FIGS. 54–60

Figure 54:
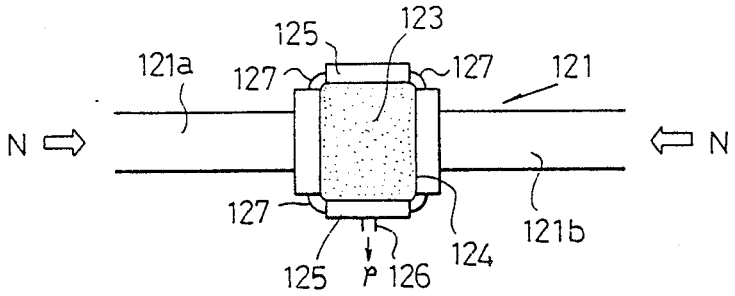
Figure 54:
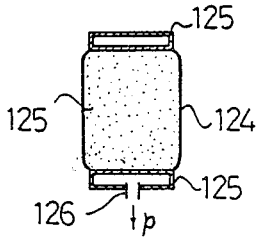
Figure 54:
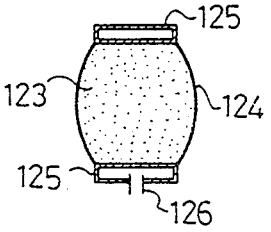
Figure 55:
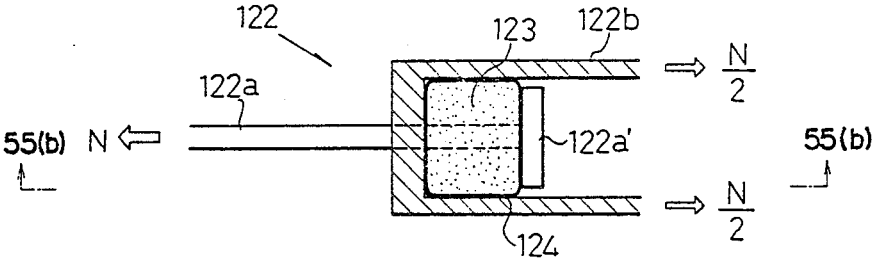
Figure 55:
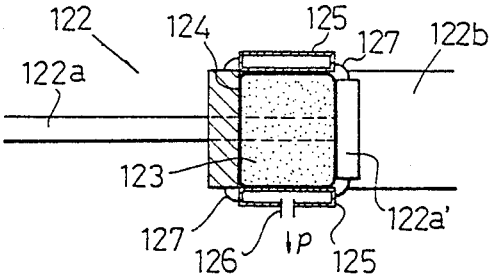
Figure 56:
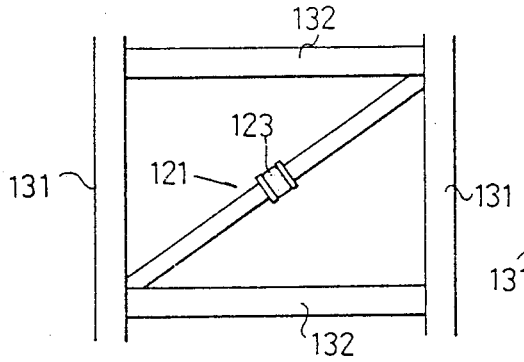
Figure 57:
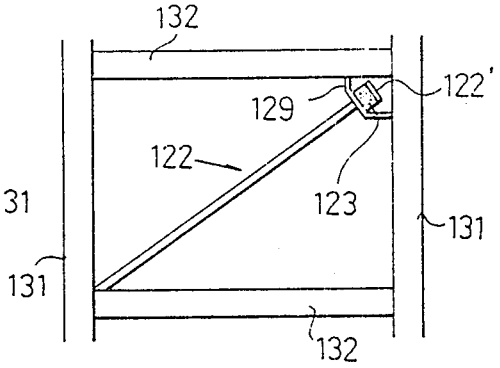
Figure 58:
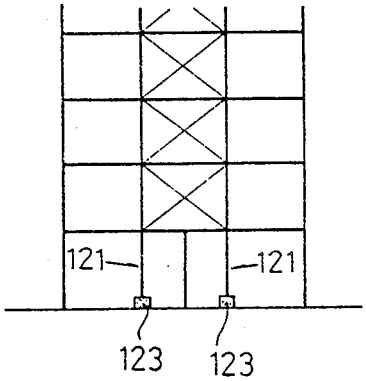

FIGS. 54(*a*) to 54(*c*) are views of a sixth embodiment of a rigidity control device in which is provided a compressive resistance material;

FIGS. 55(*a*) and 55(*b*) are sectional views of a modified sixth embodiment of the inventive device wherein the rigidity control device is adapted to provide the compressive resistant material of FIG. 54 in a tensionresisting mode;

FIGS. 56 and 57 are elevational views illustrating an application of the inventive device to a structural brace;

FIG. 58 is a schematic elevational sketch of a building structure showing the rigidity control device utilized for a pillar capable of resisting compression at the lowest level of the building;

FIG. 59(*a*) is a schematic elevational sketch of a building structure showing the rigidity control device utilized for the pillar capable of resisting tension;

FIG. 59(*b*) is a fragmentary elevational view in partial section showing an enlargement of the inventive device; and FIGS. 60(*a*) and 60(*b*) are elevational views showing the inventive device applied to an earthquake-proof wall.

DETAILED DESCRIPTION OF THE PREFERRED EMBODIMENTS OF THE INVENTION

FIRST EMBODIMENT (FIGS. 3–12)

FIGS. 3(*a*), 3(*b*) and 3(*c*) show a first embodiment of a rigidity control device 11 consisting of two elongate members 11*a* and 11*b* with a joint 12 capable of being changed over to either a pivotal pin joint or rigid joint. The pivotal pin-type joint 12 which provides a fulcrum of rotation is fixed by restrainers 13 which interconnect elongate members 11*a* and 11*b*. A drive unit for moving restrainers 13 may be of any known means, such as a hydraulic cylinder, electric motor or magnetic means.

Also, in the pivotal pin-type joint 12, an engaging arm 14 extending from one elongate member 11*a* to the other elongate member 11*b* may be provided to limit the rotational direction in the pin joint. The restrainer 13 may be provided between the engaging arm 14 and elongate member 11*b*.

The pivotal pin-type joint may be changed over to a rigid-type joint by a control program of a computer. Namely, the rigidity of the building may be controlled by the computer according to external vibrational force such as an earthquake. Therefore, the rigidity, connecting condition or the like of members in each section of the building may be varied to avoid harmonic resonance by changing the natural period of the whole building.

FIGS. 4(*a*) to 4(*e*) shown a modified embodiment of the rigidity control device 11.

Members 11*a* and 11*b* are connected to each other through the pivotal pin joint 12 and the rotational direction in the pin joint 12 is limited by the engaging arm 14 extending from one member 11*a* to the other member 11*b*. Restrainers 13 are mounted on the engaging arm 14 perpendicularly to the longitudinal axis of the rigidity control device by means of hinges 15 so as to sandwich member 11*b* therebetween. Restrainers 13 are provided near their upper ends with engaging projections 16 which may clamp or release member 11*b* by rotation about the hinges 15.

As shown in FIG. 5, if the force applied to restrainers 13 is small, the resistance may be provided by frictional contact between restrainers 13 and member 11*b* contacting therewith, instead of the positive resistance provided by the engaging projections 16 of restrainers 13. In the alternative, as shown in FIG. 6, a magnet 19 mounted on restrainers 13 or the adjacent member 11*b* may provide the required resistance.

As shown in FIGS. 4 and 5, the rotation of restrainers 13 may be automatically controlled by a simple actuator such as an electric servo motor 17 provided on member 11*b*. When rigid materials such as steel bars are used as connectors 18 for joining restrainers 13 to the servo motor 17, restrainers 13 and member 11*b* need not make surface-to-surface contact with each other. If the connector 18 is tensioned but not compressed, a cushion member is provided between restrainers 13 and the adjacent member 11*b* to dampen shocks.

The power of the servo motor 17 used for an actuator should have sufficient torque to pivot restrainerd 13 to overcome the engaging projections 16 or magnets 19. Also, when resistance is provided by friction, the motor torque must be sufficient to provide the necessary friction force.

In an alternative embodiment, the restrainers 13 may be secured to member 11*b* and the servo motor may be secured to the engaging arm 14. In addition, restrainers 13 opposed to each other may be interconnected by a hydraulic cylinder or the like. In this case, the hydraulic cylinder is extended or contracted to open or close the restrainers 13.

The restrainers 13 are released when the engaging arm 14 is pivoted into contact with member 11*b*. The maximum rotation in the pin joint 12 is such that the maximum deformation of the building stays within allowable limits.

The rigidity control device 11 may be used with building structures such as pillars, beams, and braces until they provide sufficient flexibility in the structures to withstand earthquake vibrations. Thus, even with uncertain frequency characteristics of earthquakes or the like, the building may be adapted not to resonate by constantly changing the rigidity of the building as controlled by the computer.

FIGS. 7(*a*) to 7(*c*) show the variation of a dynamic mechanism with respect to the horizontal load when the rigidity control device 11 according to the present invention is used for the beams or pillars of a building structure. FIG. 7(*a*) shows a condition in which both of two pivotal pin joints 12 provided at ends of a beam A are restrained to provide the rigid joints. FIG. 7(*b*) shows a condition in which one of the rigid joints is released from the restraint and only the other joint provides rigidity. FIG. 7(*c*) shows a condition in which both pin joints are released from their respective restraints.

FIGS. 8(*a*) to 8(*f*) show similarly the variation of the dynamic mechanism with respect to the vertical load of the beam B provided with pin joints at both ends and in the central portion of the member.

FIG. 9(*a*) shows rigidity control devices applied to a pillar or the like at the lowest story of the building. In this case, the rigidity control devices 11 are provided at their upper and lower ends with pin joints 12 capable of being restrained by the restrainers 13. However, the upper pin joints 12 are journaled in lost motion slots 12*a* so as to yield without resistance to an axial force.

FIGS. 9(*b*) to 9(*d*) are bending moment diagrams. FIG. 9(*b*) shows both moment pillars which are restrained, FIG. 9(*c*) shows one pillar which is released from the restraint at the upper and lower portions, and FIG. 9(*d*) shows one pillar which is released from the restraint only at the upper end, thereby providing no resistance within the lost motion slot.

FIGS. 10(*a*) to 10(*c*) show an application of the rigidity control device 11 according to the present invention, in which the pin joint 12 in the central portion of a three-pin structure member is provided with the restrainer 13 to permit the change-over from restraint to non-restraint. The central pin joint 12 is provided with the engaging arm 14 protruding from one member 11*a* to the other member 11*b*. The pin joint 12 is thus rotatable only in one direction when the compressive force is applied at the time of having no resistance against compression. To release the pin joint from the unstable condition at that time, the engaging arm 14 is provided on the end with a weak spring 21 which is enough to push out member 11*b* in the rotational direction. Restrainers 13 will be adequate with a relatively small cross section so as to withstand buckling when the rigidity control device is employed as a compression resisting member. It may be used in coaction with braces, pillars and leg portions of earthquake-proof walls or the like to vary the rigidity of a building frame.

FIG. 11 shows the rigidity control device utilized for the brace of a building frame, in which the rigidity control device 11 is diagonally disposed between pillars 22 and beams 23 with both ends 24 mounted on gusset plates 24*a* of pillars 22 and beams 23 by pins 12*b* and 12*c*. The central pin joint 12 may be changed over to either a flexible or rigid mode. When in the flexible mode, the pin does not resist the axial compressive force in the pin joint but does resist the compressive force in the pin joint while in the rigid mode.

FIGS. 12(*a*) and 12(*b*) show an example in which the rigidity control devices 11 of the three-pin structure on the lowermost story of the building are disposed on both sides of a central pillar 25 as earthquake-resistant pillars. The central pin joint 12 is restrained or released from the restraint to change the rigidity of the building according to the characteristics of the earthquake, as shown in FIG. 12(*b*). In FIGS. 12(*a*) and 12(*b*), reference numeral 26 designates braces or earthquake-proof walls.

SECOND EMBODIMENT (FIGS. 13–22)

As first schematically shown in FIGS. 13(*a*) and 13(*b*), a second embodiment 31 of the rigidity control device consists of two members 31*a*, 31*b* secured together by restrainer plates 33.

To prevent the axes of the pieces 31*a*, 31*b* from misalignment even if the pieces are separated from each other, it is preferable to interconnect the pieces 31*a*, 31*b* through a connecting member such as a steel rod 34 having tensile strength substantially less than that of members 31*a*, 31*b*. As illustrated, the connecting rod 34 is mounted on the corresponding planar surfaces of members 31*a*, 31*b* to prevent misalignment therebetween.

Figure 1:
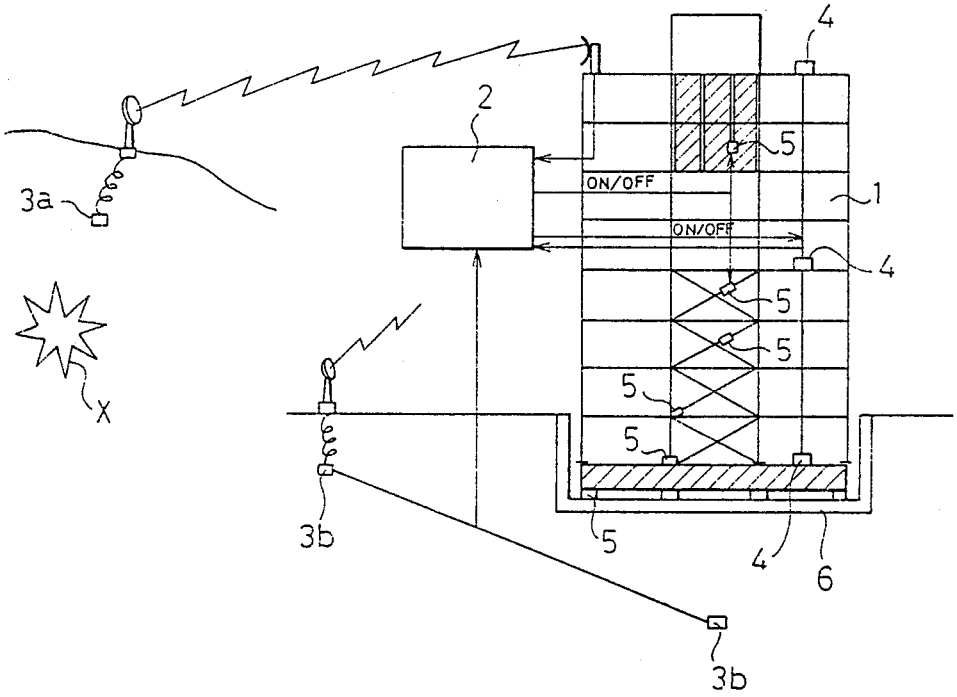
FIG. 1 is a schematic diagram showing an application of the inventive concept.
Figure 2:
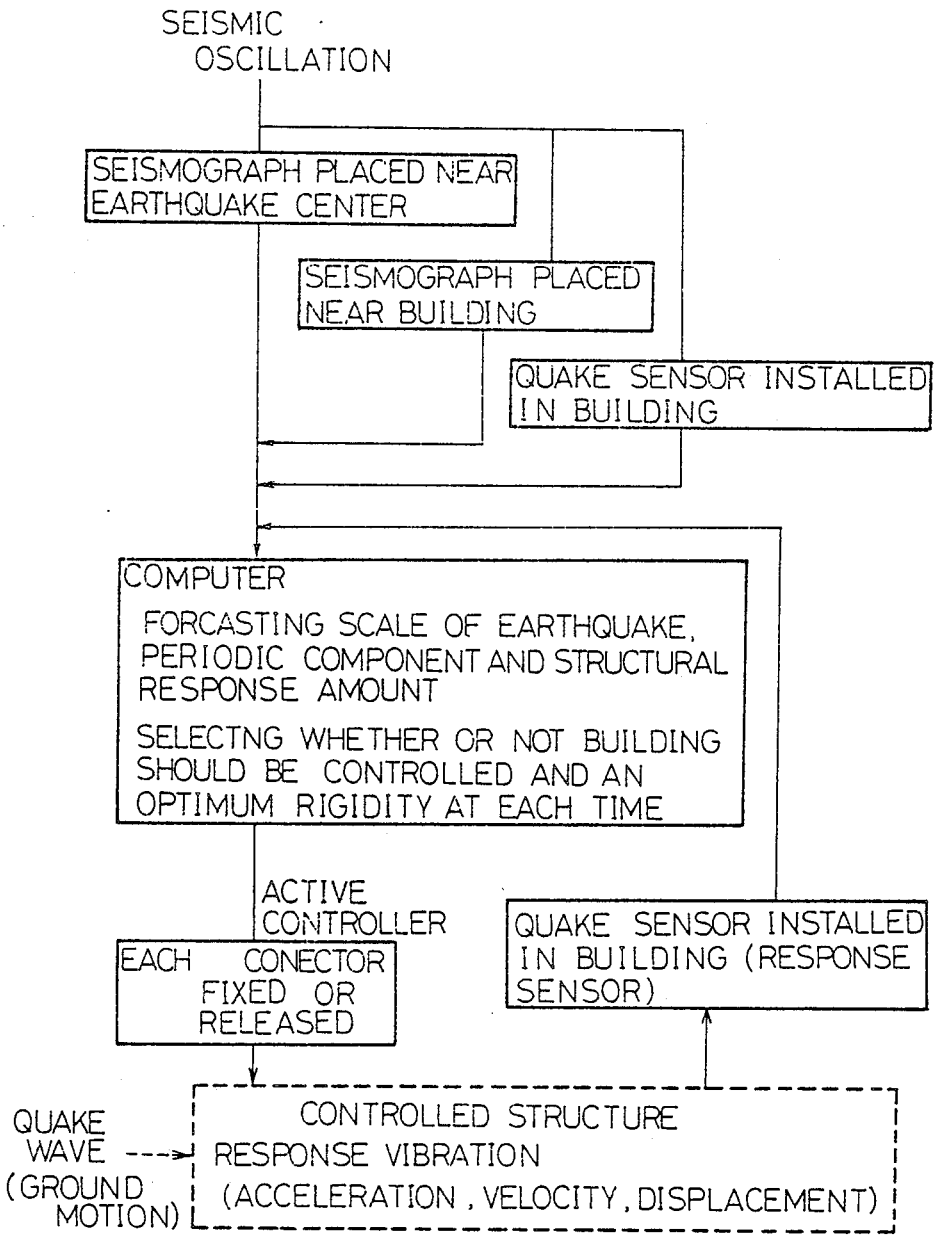
FIG. 2 is a block diagram of an application of the inventive concept schematically shown in FIG. 1.

Means to actuate the rigidity control device 31, such as a servo motor, may be activated by the control program of the computer 2 (FIG. 1). Namely, the rigidity may be controlled by the computer according to external vibrational forces, such as an earthquake, to change the rigidity of the structural members in each section of the building and the natural period of the whole building, thereby avoiding destructive harmonic resonance.

FIGS. 14(*a*) to 14(*d*) show in greater mechanical detail the rigidity control device shown schematically in FIGS. 13(*a*) and 13(*b*), wherein like numbers refer to like members. Mounting flanges 37*a* and 37*b* are provided to carry threaded rod connecting members 34.

The threaded pintle 35 is adapted to be rotated by a servo motor 38, which is controlled by the computer 2, through gears 39*a*, 39*b*. The threaded pintle 35 is rotatably supported by a lower support bracket 40 fixed to the lower side of member 31*a* and by an upper bracket 41 fixed to the upper side of member 31*a*. Pintle 35 engages through nuts 36 the respective upper and lower restrainer plates 33 provided on opposite surfaces of members 31*a* and 31*b*. Thus, the two restrainer plates 33 are movable simultaneously by rotation of the drive shaft of servo motor 38. Restrainer plates 33 are shaped symmetrically about the threaded pintle 35 to provide balance and stability. Also, in this embodiment, the restrainer plates 33 are provided on the side of member 31*a* with gudgeons 42 to receive therein in sliding engagement therewith a plain pintle member 43 extending through member 31*a*.

FIGS. 15 and 16 show modifications of a drive mechanism for use in association with the device of FIGS. 13 and 14. In the example shown in FIG. 15, a motor 38' is mounted on the shaft 38*a* of the threaded pintle 35 and secured to the upper support bracket 41. In FIG. 16, a support bracket 41' for the threaded pintle 35 is mounted directly on the member 31*a*. In the drawing, reference numeral 44 designates a detent for limiting the movement of the restrainer plates 33.

FIGS. 17(*a*) to 17(*d*) show several examples of drive mechanisms mounted on the side of member 31*a*. Namely, the threaded pintle 35 and nut 36 for shifting restrainer plates 33 are mounted on one side of the member 31*a* and restrainer plates 33. A plain pintle 43 and gudgeons 42 fixed to the restrainer plates 33 are mounted on the opposite side of the member 31*a*. The servo motor 38, FIG. 17(*d*), is supported by a bracket 45 protruding sidewise from the member 31*a* to drive the threaded pintle 35 through gears 39*a*, 39*b*. In FIGS. 17(*a*) to 17(*d*), pintle nuts 36 and motors 38 may be provided on both sides of the member 31*a* for increased torque to operate restrainer plates 33.

FIG. 18 illustrates a rigidity control device 31 attached to a cross brace 31*b* in a building frame. When the members 31*a*, 31*b* of the rigidity control device 31 are restrained by the restrainer plates 33, a structure capable of resisting compressive and tensile forces is obtained similar to that of an ordinary cross brace. However, the rigidity control device 31 cannot resist the forces of tension or compression when the restrainer plates 33 are separated. When the restrainer plates 33 are selectively separated by computer command, the rigidity of the entire building is changed.

FIGS. 19(*a*) and 19(*b*) illustrate rigidity control devices 31 according to the present invention used for building pillars 46*a* and 46*b* on both sides of pillar 46 to resist earthquake-imposed forces at the lowermost level of the building. Both rigidity control devices are restrained as shown in FIG. 19(*a*). In FIG. 19(*b*), a rigidity control device 31 on pillar 46*b* is no longer restrained, thereby permitting pillar 46*b* to yield to forces imposed thereon by an earthquake tremor. Reference numeral 47 in FIG. 19(*a*) designates a brace or earthquake-proof wall.

FIGS. 20 and 21 show rigidity control devices applied to a building brace in which rigidity is maintained with respect to the tensile forces, while being flexible with respect to the axial compressive force. Thus, members 31*b*', 31*c*' (FIG. 20) or members 31*a*', 31*b*' (FIG. 21) of a rigidity control device 31' are interconnected with each other by a common pin 51. The example of the rigidity control device 31' shown in FIG. 20 is comprised of three members 31*a*', 31*b*' and 31*c*'. The pin 51 is provided so that the restrainer plates 33 maintain rigidity with respect to tensile forces between the members 31*a*' and 31*b*'. In the example shown in FIG. 21 the rigidity control device 31A is comprised of two members 31*e* and 31*f* so that the restrainer plates 33 have lost motion slots 51*a* in which pins 51 shift responsive to a compressive force.

FIG. 22(*a*) shows rigidity control devices 31' which resist both compressive and tensile forces. FIG. 22(*b*) shows the condition in which the pillar for the axial force at the left side in the drawing is adapted to resist tensile force but not compressive force, while the pillar at the right side is adapted to resist compressive force, but not tensile force. The rigidity of respective pillars and whole buildings may be changed responsive to the various forces imposed on a building by earthquake tremors.

THIRD EMBODIMENT (FIGS. 23–36)

As shown schematically in FIGS. 23(*a*) and 23(*b*), a third embodiment A of a rigidity control device is formed of pin joints 65*a*, 65*b*, main members 61, 62 opposed to each other in the dog-legged form and a connecting member 63 disposed between said pin joints 65*a*, 65*b*. Both ends of the main members 61, 62 have the pin joints 64*a*, 64*b* in common to receive the axial force N therefrom. The connecting members 63 disposed between the intermediate pin joints 65*a*, 65*b* are removably attached to at least one of pin joints 65*a*, 65*b*. Thus when the connecting member 63 engages the pin joints 65*a* and 65*b*, the rigidity control device A provides a stable structure. When the connecting member 63 is disengaged from the pin joints 65*a*, 65*b*, the rigidity control device is enabled to yield to axial force N.

Members 61*a*, 61*b*, 62*a*, and 62*b*, constituting the main members 61, 62, and the connecting members 63 have sections defined to have the basic axial rigidity capable of resisting the axial force N for a stable structure. Also, the basic rigidity of the rigidity control device A for the axial force resisting member when said member A has the stable structure may be selected according to angle $\theta$ of the dog-legged form (an angle made between the axial direction and the member constituting the main members 61, 62).

While, in consideration of the engagement and disengagement only at the end of the connecting member 63, the rigidity varies between the zero rigidity and the basic rigidity, the rigidity may be selected in a plurality of stages for the axial force resisting material if the connecting member 63 is detachably disengaged from the intermediate pin joints 65*a*, 65*b* at a plurality of positions.

Also, the connecting member 63 may be either a combination of both the tension resisting member 63*a* resisting the axially outward movement of the intermediate pin joints 65*a*, 65*b* and the compression resisting member 63*b* resisting the axially inward movement, or a single member which may resist either tension or compression.

The change-over of the connecting member 63 between the engagement with and disengagement from the pin joints 65*a*, 65*b* may be carried out by utilizing the rotational motion (see FIG. 29(*a*)) of a servo motor, pulse motor, or the like, or by utilizing the linear motion (see FIG. 29(*b*)) of a hydraulic jack 62*c*. The method of change-over operation is not limited. Since the building avoids the resonant phenomenon caused by an earthquake through the removable engagement of connecting member 63, said change-over operation is effectively carried out when the rigidity is required to be changed. Namely, the connecting member 63 may be automatically controlled on the basis of the control program of the computer so that the rigidity of the members in each section of the building may be changed according to external vibrations forces to change the natural period of the entire building, thereby avoiding destructive resonances.

In FIGS. 23(*a*) and 23(*b*) noted above, the tension resisting member 63*a* for the connecting member 63 is pivotable about the pin joint 65*a* and an engaging portion 66*a* at the end of the connecting member engages the outside of the pin joint 65*b*. The compression resisting member 63*b* is pivotable about the pin joint 65*b* and an engaging portion 66*b* at the end of said member 63*b* engages the inside of the pin joint 65*a* to be operated as follows:

(1) FIG. 24(*a*) shows both tension resisting member 63*a* and compression resisting member 63*b* for the connecting member 63 released from engagement. In this case, as shown in FIG. 24(*b*), the rigidity control device A provides an unstable structure which does not resist axial force N.

Figure 25A:
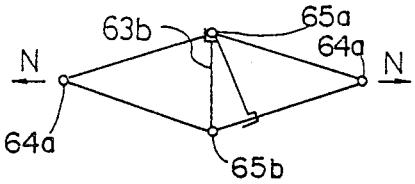
Figure 25B:
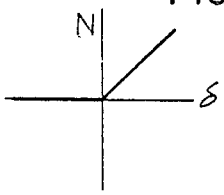

(2) FIG. 25(*a*) shows only the compression resisting member 63*b* engaging the pin joint, in which the compression resisting member 63*b* works when force N acts on the rigidity control device A. As shown in force diagram FIG. 25(*b*), the rigidity control device A shows compression resistance. In this case, the rigidity control device A does not resist tension force N.

Figure 26A:
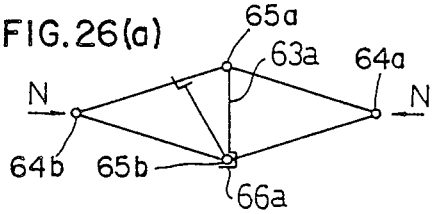
Figure 26B:
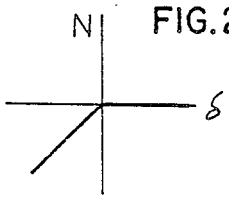

(3) FIG. 26(*a*) shows only the tension resisting member 63*a* engaging the pin joint 65*b*, on which the tension resisting member 63*a* works when force N acts on the rigidity control device A. As shown in force diagram FIG. 26(*b*), the rigidity control device A shows the tensile resistance. In this case, the rigidity control device A does not resist the compressive force N.

Figure 27A:
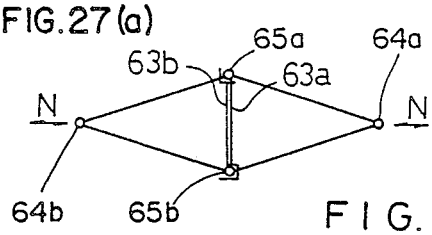
Figure 27B:
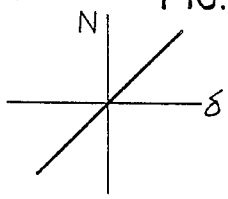

(4) FIG. 27(*a*) shows both tension resisting member 63*a* and compression resisting member 63*b* engaging the pin joint 65*a* and 65*b*, respectively. In this case, the rigidity control device A may resist either tension or compression, as shown in FIG. 27(*b*).

Figure 28:
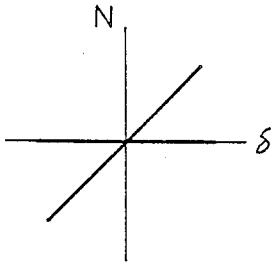

(5) The connecting condition may be varied between the conditions (1) to (4) noted above by the engagement and disengagement of the connecting members 63*a* and 63*b* so that the forces on the rigidity control device are as shown in FIG. 28 to permit the two stage change in rigidity. By selectively engaging the pin joints 65*a* and 65*b* at a plurality of positions, the rigidity of building structural members may be varied in a plurality of stages.

FIGS. 30 and 31(*a*) to 31(*d*) illustrate a particular example of the third embodiment of the invention, in which members 61*a*, 61*b*, 62*a* and 62*b*, made of H-beam structural steel, are interconnected with pin joints 64*a*, 64*b*, 65*a* and 65*b* and the outboard ends of compression resisting member 63*b* and tension resisting member 63*a* are respectively mounted on the intermediate pin joints 65*a*, 65*b*. The compression resisting member 63*b* has at its pin-secured end a pulley 72*a* mounted about the axis of the pin joint 65*a* and is rotated by a belt 73*a* drivingly connected to pulleys 71*a* and 72*a*. A motor 69*a* to drive belt 73*a* is fixed to the member 61*a* by means of a mounting plate 70, FIG. 31(*b*). The compression resisting member 63*b* is formed on the end with an open L-shaped engaging portion 66*b* capable of engaging the inside of a shaft of the opposed pin joint 65*b* by the rotation of the compression resisting member 63*b*. The tension resisting member 63*a* has similarly at its pin-secured end a pulley 72*b* mounted about the axis of the pin joint 65*b* to be pivoted by a motor 69*b* fixed to the member 62*b*. A closed L-shaped engaging end portion 66*a* engages the outside of the shaft of the opposed pin joint 65*a*.

Reference numerals 74, 75 in FIG. 31(*a*) designate respectively detents for preventing the engaging portions 66*b*, 66*a* of respective compression resisting member 63*b* and tension resisting member 63*a* from shifting toward the opposite sides of the pin joints 65*a*, 65*b*. Further, in this embodiment as shown in FIG. 31(*d*), the compression resisting member 63*b* is made of I-beam structural steel and the tension resisting member 63*a* is made of channel beam structural steel.

FIG. 32 illustrates the inventive device applied to a brace of a building frame in which the rigidity control device A according to the present invention is disposed on a diagonal between pillars 76 and beam 77. The seismic motion which varies continuously during an earthquake is analyzed by a computer which commands the rigidity control device A to change the connecting condition so that rigidity may be varied to avoid destructive resonance.

FIG. 33 shows an example of the rigidity control device A′ capable of changing the rigidity of a structural member in a plurality of stages. FIGS. 34(*a*) to 34(*f*) show the manner of change in rigidity. The tension resisting member 63*a*′ for the connecting member 63 is pivotable about the pin joint 65*a*. Any one of three engaging portions 68*a*, 68*b* or 68*c* near the end may engage the outside of the pin joint 65*b*, and the rigidity control device A′ may change the rigidity of a structural member from complete rigidity to zero rigidity in four stages with respect to compressive forces. Also, the compression resisting member 63*b*′ is pivotable about the pin joint 65*b* such that any one of the three engaging portions 67*a*, 67*b* or 67*c* near the end may engage the inside of the pin joint 65*a*. The rigidity control device A′ may change the rigidity in four stages with respect to tensile forces. FIG. 35 shows the change in rigidity as the relationship between the axial force N acting on the rigidity control device A′ and the displacement δ thereof in the direction of the axial force N.

While the resisting member 63 consists of two members 63*a* and 63*b* in the example noted above, a single connecting member 63 may resist tension and compression as shown in FIG. 36.

FOURTH EMBODIMENT (FIGS. 37–48)

A fourth embodiment of the rigidity control device as shown in FIG. 37 uses a main member 81 which is arcuately formed to resist bending forces from pillar 83 or cross beam 84. Provided on its central portion is a drive unit 82 for applying force perpendicular to a straight line passing through joints 88 at opposite ends of the main member 81.

The drive unit 82 may be a hydraulic or electric actuator or the like having a servo mechanism. While the size and direction of the force acting on the main member 81 or any change in the linear distance between ends of the member are detected by sensors, the actuator may be operated on the basis of the control program of the computer such as a microcomputer to obtain the proper rigidity with the automatic control. Namely, the rigidity may be controlled by the computer according to external vibrational force such as an earthquake, so that the rigidity and connecting condition of the members in each section of the building may be changed to change the natural period of the whole building and thereby avoid destructive earthquake resonance.

Further, as will be later described, since the rate of change in the rigidity is varied by the rise span ratio due to bending of the main member 81, the rise span ratio should be selected as carefully as possible.

FIGS. 41(*a*), 41(*b*) and 41(*c*) show schematically the principle in the use of arcuately bent main member 81 of the rigidity control device. As shown in FIG. 41(*a*), when the axial force N acts on the main member 81, bending strain $M=Ny$ is produced therein, in addition to the axial force N, and a bending deformation component is added to the axial deformation $\delta_1$, in addition to the axial deformation component.

As shown in FIG. 41(*b*), when force P is applied to the central portion of the bent member as the main member in the direction perpendicular to the axial direction, the axial deformation $\delta_2$ is produced by the bending strain.

Thus, as shown in FIG. 42(*c*), by applying the force P to the bent member on which the axial force N acts may be adjusted an amount of the axial deformation $\delta_3$. Further, while FIGS. 41(*a*), 41(*b*) and 41(*c*) show the examples of tensile force, the fact noted above applies to the compressive force.

Also, as shown in FIGS. 42(*a*) and 42(*b*), the main members formed in the dog-legged manner may be considered similarly.

Next, the theoretical development of the main member formed in the dog-legged manner will be described on the basis of FIGS. 43(*a*) and 43(*b*). Further symbols used here are as follows:

E: Young's modulus of main member
A: Sectional area of main member
I: Secondary moment of section of main member
i: Secondary radius of section of main member
λ: Thickness-length ratio of main member (=l/i)
l: Length of main member
a: rise of main member
N: axial force
P: Force for rigidity control
δxl: Axial deformation by N
δyl: Deformation of angle by N
δx2: Axial deformation by P
δy2: Deformation of angle top by P
δx: Sum of δxl and δx2
δy: Sum of δyl and δy2

In FIG. 43(*a*), δxl and δyl are represented respectively by the following formulas (1) and (2).

$$\delta xl = Nl/EA + Na^2l/3EI \quad (1)$$

$$\delta yl = Nal^2/12EI \quad (2)$$

In FIG. 43(*b*), δx2 and 67 y2 are respectively represented by the following formulas (3) and (4).

$$\delta x2 = Pal^2/12EI \quad (3)$$

$$\delta y2 = Pl/48EI \quad (4)$$

In order to obtain the rise span ratio (a/l), which is the most efficient for varying the rigidity, from the formulas (1) and (3), the following formulas (5) is first referred to:

$$(\delta x2/P)/(\delta xl/N) = 1/4[(l/a)\,(3/\lambda) + (a/l)] \quad (5)$$

When the value of formula (5) is maximized, i.e. the rise span ratio is within the following formula (6), the best efficiency is obtained (a large change in rigidity is obtained from small control force):

$$a/l = \sqrt{3}/\lambda \quad (6)$$

Then, the formula (5) becomes the following formula (7):

$$(\delta x1/P)/(\delta x1/N) = \lambda/8\sqrt{3} \quad (7)$$

When an axial spring constant K is obtained when the rise span ratio is represented by the formula (6), the following formula (8) is obtained. According to this formula, the spring constant under the action of control force P is found to be $\phi$ times the spring constant N/δx1 in the absence of control force P:

$$K = N/(\delta x1 + \delta xz) = (N/\delta x1)\,\phi = k\phi \quad (8)$$

where $\phi$: Coefficient of variation in axial rigidity $$\phi = 1/[1 = \beta(\lambda/8\sqrt{3})] \quad (9)$$

$\beta$: Coefficient of control force $$\beta = P/N \quad (10)$$

FIG. 44 shows the relationship between the coefficient $\phi$ of variation in the axial rigidity and the coefficient $\beta$ of control force. From this relationship is found that when $\beta$ is in the minus side, i.e. the control force P is operated to reduce the axial deformation δx caused by the axial force N, the variation in rigidity is enlarged. For example, the rigidity is magnified by about 3.6 times with the control force of only 0.2N in the case of λ=50.

When the rise span ration is set to $a/l = \sqrt{3}/\lambda$, the main member has the maximum stress $\sigma$ max which is approximately represented as shown in the formula (11) when the main member has a box-like section. The main member will do with about 3 times section of an ordinary axial force resisting member when controlled to make $\beta$ minus, i.e., only to increase the rigidity.

$$\sigma max = N/A(3.12 + 0.306\beta\lambda) \quad (11)$$

From the above theoretical development will be apparent the dynamic features of the variable rigidity member of this embodiment as follows:

(1) The most efficient rise span ratio is found in the rigidity change viewed from the control force, i.e., the case of $a/l = \sqrt{3}/\lambda$ in an angle bar. The rise span ratio of the variable rigidity member shall be approximated to that case.

(2) When the control force is applied to make the deformation smaller, i.e. more rigid, the rigidity increases in accordance with the function of the rigidity control device. For example, when λ=50 in the angle bar, the rigidity is magnified by 3.6 times with the control force corresponding to 20% of the axial force.

(3) The section of member used for the rigidity control device will do with about 3 times the section necessary for a linear member when the rigidity is controlled only in the direction of increasing the rigidity.

FIG. 37 illustrates the utilization of a rigidity control device for a brace. The main member 81 which is arcuately bent is disposed on a diagonal in a plane between pillars 83 and beams 84, to be connected at opposite ends to gusset plates 89. On another diagonal is provided an actuator 82 hydraulically controlled between the upper corner and the central portion of main member 81 so that force may be applied perpendicularly to the main member 81 by the extension and contraction of the actuator. FIG. 38 shows an example of the structure of the actuator 82 for the drive unit, in which oil pressure may be varied by a servo valve 87 to control applied force. Further, a piston 86 in the actuator 82 is connected to the main member 81 through pressure plates 91 which secure the main member 81 by bolt means 92. Force may be applied to the main member 81 through pressure plate 91. A structural steel H-beam is used for the main member 81.

FIGS. 45 and 46 are schematic diagrams for analyzing the embodiment of the rigid-release device in which the reaction of the control force acting on the main member 81 through the actuator 82 has to be considered to act on the pillars 83 and beams 84. Thus, axial force ΔN will be applied to the main member 81 for a brace in the action of the control force.

In FIG. 45, the following formula (12) is obtained in the case of h/l=1.

$$\Delta N = -0.5P = -0.5\beta N \quad (12)$$

Thus, the spring increase ratio is changed by $N/(N = \Delta N) = 1/(1\text{-}1\text{-}0.5\beta)$ times and the coefficient $\phi$ of change in rigidity is corrected as follows:

$$\phi' = \phi/(1\text{-}0.5\beta) \quad (13)$$

This is represented by a graph with the thickness length ratio λ=50 in FIG. 46.

FIG. 47 shows a graph representing the relationship between the axial force N and the axial deformation δx (extension and contraction) when the rigidity is varied with the axial variable member. In the relationship between the axial force N and the deformation δx of the brace, the rigidity may be relatively easily changed to the amount $\phi' = 1\text{-}3$ and in an ordinary building the stroke of the actuator is preferably about ±3 cm. Also, the change in rigidity may be controlled by measuring strain between A and B in FIG. 45.

FIGS. 39 and 40 show also an example of the main member 81 used for a brace, in which an actuator 93 is mounted to interconnect the central portions of a pair of two angle members. In this case, the actuator 93 for a control unit is received in the brace to provide a compact control unit. Also, it is advantageous in that it is not affected by the reaction of said example.

As above mentioned, in the fourth embodiment, the rigidity of the axial resisting member may be easily varied by a combination of bent or dog-legged formed main member and the actuator or the like.

Also, the rigidity change may be controlled by strain measurement or the like so that it may immediately respond to external vibrational force like an earthquake to provide an element for changing the rigidity and natural frequency of the whole building through the control of the computer. Further, the strength of the member may be easily ensured by enlarging the section of the member.

FIFTH EMBODIMENT—(FIGS. 49-53)

A fifth embodiment will be described with reference to the schematic diagram, FIG. 49. As shown in FIG. 49, the rigidity control device B is an axial force resisting member in which the intermediate portions of dog-legged main members 101, 102 having in common points (shown by pins 104*a*, 104*b* in the drawing) which receive the axial force N are interconnected respectively by pins 105*a*, 105*b* which are interconnected by a connecting member 103. The axis of the connecting member 103 is at a right angle to the direction of the axial force N and has a drive unit 106 receiving force perpendicular to the axial force. Members 101*a*, 101*b*, 102*a* and 102*b* constituting the main members 101, 102 and members 103*a*, 103*b* constituting the connecting member 103, have sections defined to provide the basic axial rigidity which may resist the axial force N respectively as a stable structure.

Further, the basic rigidity for the axial force resisting member may be selected according to an angle θ of the dog-legged member in the stationary condition (angle made between the axial direction and members constituting the main members 101, 102) and the basic rigidity of the connecting member 103. That is, even if the control force by the drive unit 106 of the connecting member 103 is not considered, the basic rigidity may be at will changed according to the angle θ.

For the drive unit 106 are provided a hydraulic actuator having a servo valve, a digital type hydraulic actuator using an electric pulse motor, and a unit utilizing a nut within which to rotate a bolt by an electric servo motor for varying the gap between members 103*a*, 103*b* of the connecting member 103. The control force P caused by these drive units 106 acts effectively when it is required that the rigidity be varied continuously to dampen the resonant phenomenon of the building during an earthquake. The drive unit 106 may be automatically controlled on the basis of the control program of the computer so that the rigidity of members in each section of the building may be varied according to an external vibrational force to change the natural period of the entire building to avoid destructive resonance. Further, referring to the basic rigidity of the connecting member 103, a coiled spring or the like may be interposed in parallel to the drive unit 106, if necessary, to ensure predetermined rigidity even if the drive unit 106 is not operated.

When the angle θ is selected as above mentioned, the basic rigidity Ko is unconditionally defined such that the deformation in the direction of the axial force N is proportional to the axial force, while the control force P caused by the drive unit 106 provided on the connecting member 103 varies the basic rigidity Ko. Namely, by further adding or subtracting the control force P to or from the extension or contraction of the connecting member 103, force N may be increased in the direction perpendicular to the direction of the axial force N in the joints of pins 105*a*, 105*b*.

The basic rigidity Ko in the operative direction of the axial force N defines unconditionally the relationship between the axial force N and the deformation δ in the operative direction of the axial force N as shown in the following formula (14) (see FIG. 50(*a*)), while the deformation may be varied only by Δδ when the control force P acts on the connecting member (see FIG. 50(*b*)). Therefore, the same variation of rigidity as that of rigidity K is obtained as shown in the following formula (15):

$$Ko = \frac{N}{\delta} \tag{14}$$

$$K = \frac{N}{\delta + \Delta\delta} \tag{15}$$

FIGS. 48(*a*) to 48(*c*) show respectively an example of a structure of the variable rigidity control device B. Opposed main members 101, 102 interconnect respectively members 101*a*, 101*b* and 102*a*, 102*b* through pins 105*a*, 105*b* and interconnect both ends which receive the axial force through common pins 104*a*, 104*b*. In this embodiment, while the sections of respective members 101*a*, 101*b*, 102*a* and 102*b* are of I-beam type sections as shown in FIG. 48(*c*), they are not limited thereto.

The joints of the pins 105*a*, 105*b* are interconnected by the connecting member 103 which has U-shaped members 103*a*, 103*b* disposed back to back as shown in FIG. 48(*b*) for example and interconnected by a bolt 107. By rotating the bolt 107 with an electric servo motor 106*a* for the drive unit 106, the member 103*a* moves toward or away from the other member 103*b* by means of a nut 108 fixed to the member 103*a* to provide the control force P. Thus, the rotation of the motor 106*a* is converted into the linear motion of the bolt 107 so that the control force may be obtained by giving acceleration to the main members 101, 102. Reference numeral 109 in the drawing designates a detent. FIG. 48(*d*) shows an example in which the hydraulic cylinder 106*b* having a servo valve may be used for control with direct force, instead of the electric servo motor 106*a*.

Considering the case when the axial force N is tensile force, the rigidity K is reduced according to the formula (15) noted above by operating the drive unit 106 to activate the control force for converging a gap between the pins 105*a*, 105*b*. Conversely, by activating the control force for diverging the gap between the pins 105*a*, 105b, $\Delta\delta$ in the formula (15) takes a minus value to increase the rigidity K. When the axial force N is a compressive force, the change in the rigidity K may be obtained from the formula (15).

FIG. 51 shows an example of the rigidity control device B applied to a brace. FIG. 52 illustrates rigidity control devices used on both sides of a pillar 110 to be utilized for pillars resisting bending moment during an earthquake. The rigidity K of the rigidity control device B may be changed by the control force caused by the operation of the drive unit 106 to avoid destructive resonance. Reference numeral 111 in the drawing designates an earthquake-proof wall or brace.

FIGS. 53(a) to 53(c) show the rigidity control device B interconnected through pins at the lowermost level of the building to be used for a brace. When the basic rigidity of the connecting member is minimized, the horizontal rigidity at the lowermost level is determined by the control force. The rigidity of the brace is adapted to increase against lateral force against the building side such as wind (see FIG. 53(a)). Also, the control force is adjusted to reduce the rigidity of the brace against force coming from an earthquake (see FIGS. 53(b) and 53(c)).

The above-mentioned mechanisms are basically identical with each other except increasing somewhat the horizontal rigidity of the pillar even in the use of rigid joint instead of the pin joint for the connection so long as the pillar is used for an ordinary building. In particular, the pillar rigid joint facilitates the steel skeleton construction and the arrangement in erection to give advantages in economy and execution. Said mechanisms may be also used as dampeners to cancel swings by the control force of the drive unit 106 against large deformation.

SIXTH EMBODIMENT—(FIGS. 54–60)

A sixth embodiment of the rigidity control device utilizes the principle of a casting method for metal by which, after dry sand or sand-like substance is enveloped in a film such as vinyl, the internal air is removed by a vacuum pump to compact the sand firmly. When the vacuum pump is stopped and a valve is opened, the sand is returned to its original condition instantly.

Accordingly, when sand sealed by the film is placed in an axial member and the vacuum pump is operated to withdraw the internal air through a filter or the like, then the sand is solidly compacted to provide an axial force resisting member. When the vacuum pump is stopped and the valve is opened, the sand is then loosened and no longer resists the axial force. The vacuum pump and valve may be operated instantly by the command of the computer. By operating this rigidity control device according to the vibrational magnitude of the earthquake the rigidity of the building may be varied to deal with earthquake forces.

The rigidity control device may be interposed in members such as pillars, beams and braces or between connecting members, earthquake-proof walls and other building members. Further, since sealed sand or sand-like substance may be maintained in a firmly compacted condition for a considerably long time (2–3 hours for example) by closing the valve immediately after the vacuum pump is stopped, the sand may be utilized as a rigidity control device which may be varied as required.

FIGS. 54(a), 54(b) and 54(c) show rigidity control devices in which sand 123 is sealed in a film 124 to provide a compression resisting member 121 which receives the axial force N in the compressive direction to be varied between a solidly compacted condition and a loosened condition. The compression resisting member 121 either resists or does not resist the axial force N. The rigidity control device is one in which the film 124 is mounted on a frame member 125 made of metal sections or the like, into which sand 123 is packed and hardened by means of a vacuum pump which removes air from the sand. The suction of the pump is carried out from a suction port 126 of the hollow frame member 125 to remove the internal air through a plurality of orifices provided in a filter or the like contacting the sand 123. A flexible frame support member 127 interconnects members 121a, 121b constituting the compression resisting member 121 and the frame member 125.

FIG. 54(b) is a sectional view showing a portion of the rigidity control device when resisting a compressive force. In this device, pressure in the film 124 is reduced through a suction port 126 by a vacuum pump to provide the required solidly compacted condition of sand 123. About 400–500 mmHg will suffice for vacuum pressure. FIG. 54(c) shows the condition of no resistance wherein the sand 123 is loosened by returning the pressure in the film 124 to the original condition.

FIGS. 55(a) and 55(b) show an embodiment of the device wherein the sand 123 is sealed in the film 124 to provide a tension resisting member 122 to receive the axial force N. The device may be varied between the firmly compacted condition and the loosened condition so that the tension resisting member 122 may or may not resist the axial force N. One member 122a extends through the other member 122b and the sand 123 sealed in the film 124 to transmit stress through the head 122a' during the firmly compacted condition of the sand 123.

FIG. 56 shows the compression resisting member 121 provided in the cross brace of a building frame. The sand 123 resists the axial force in the compressive direction when vacuum pressure is applied to the sand 123 to compact the sand firmly. Conversion between resistance and no resistance is controlled by the computer. FIG. 57 shows an example of the tension resisting member 122 having the rigidity device interposed in the joint end of the brace through a support bracket 129. In this case, the rigidity control device can not resist an axial compressive force, but may be varied to resist a tensile force.

Figure 59A:
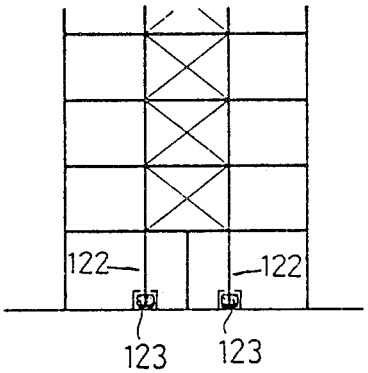
Figure 59B:
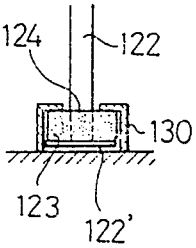

FIG. 58 shows the rigidity control device provided on the lower ends of pillars to receive axial compressive force at the lowermost level of the building, whereby the resistance and non-resistance against the axial compressive force. FIG. 59(a) shows the tension resisting members 122 as pillars which are varied between the resistance and non-resistance against the axial tensile force. As shown in FIG. 59(b), the lower end 122' of the tension resisting member 122 engages a support member 130 through the sand 123 sealed by the film 124. The pillars for the axial forces shown in FIGS. 58 and 59(a) and 59(b) may be used in combination in a building frame.

Figure 60A:
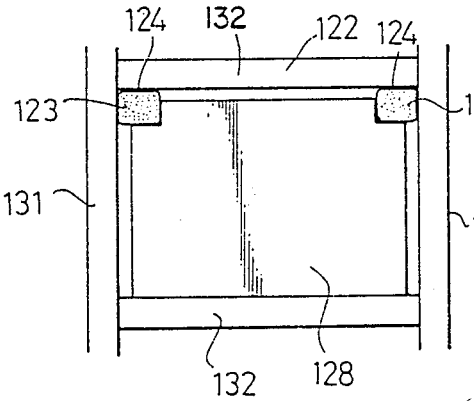
Figure 60B:
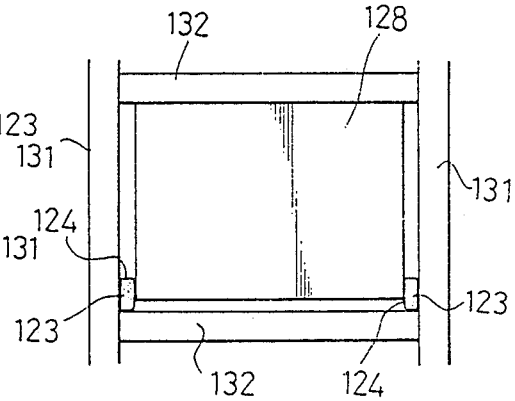

FIGS. 60(a) and 60(b) show structures in which the sand 123 sealed by the film 124 is interposed between the earthquake-proof wall 128, pillar 131 and beam 132. The sand may be selectively and firmly compacted by the operation of a vacuum pump. The earthquake-proof wall 128 will not resist seismic forces when the sand is in the loosend condition.

As above-mentioned, the sixth embodiment utilizes the sand or sand-like substance which is sealed by film, firmly compacted under vacuum-created pressure reduction and returned to the original loosened condition when the pressure is returned to the original condition. The sand may be applied to the component members of the building frame or the joints of the component members to vary the rigidity of the building.

It will be understood that the above-described embodiments of the invention are for the purpose of illustration only. Additional embodiments, modifications and improvements can be readily anticipated by those skilled in the art based on a reading and study of the present disclosure. Such additional embodiments, modifications, and improvements may be fairly presumed to be within the spirit, scope, and purview of the invention as defined in the subtended claims.

What is claimed is:

1. In combination with structural members of a building subject to stresses caused by seismic tremors, seismic detector means; mechanical rigidity control devices adapted to relieve said stresses secured between first and second structural members; actuating means adapted to activate said devices; and control means adapted to activate said actuating means responsive to seismic tremors when said seismic tremors reach a predetermined level of intensity; a preselected number of said first and second building structural members being equipped with said devices; said actuating means being further adapted to selectively actuate said devices to vary the rigidity of said building; said actuating means including computer means in communication with said seismic detector means, adapted to selectively actuate said rigidity control devices responsive to communication between said computer and said seismic detector means whereby the natural vibration period of said building is varied as required to protect it from destructive earthquake induced vibration.

2. In combination with structural members of a building subject to stresses caused by seismic tremors, a rigidity control device comprising a first member securable to a structural member and a second member securable to another structural member, means to pivotally secure said first and said second members together, first detent means secured to said first member and adapted to delimit pivotal movement between said first and second members, second detent means secured to said first detent means and adapted to prevent pivotal movement of said members, and means to selectively release said second detent means to thereby permit stress relieving pivotal movement between said first and second members.

3. The device of claim 2 wherein said second detent means comprises integrally connected first and second legs, means to hinge the remote end of said first leg to said first detent whereby said second leg is pivotable into and out of restraining engagement with said second member, and means to selectively pivot said second leg into and out of restraining engagement with said second member.

4. The device of claim 3 wherein said means to selectively pivot said second leg into and out of restraining engagement with said second member is computer controlled.

5. The rigidity control device of claim 1 or 2, wherein said device is adapted to release upon the application of a predetermined level of stress.

6. The rigidity control device of claim 1 or 2, wherein said device is adapted to release when said device is subjected to a predetermined load in tension.

7. The rigidity control device of claim 1 or 2, wherein said device is adapted to release when said device is subjected to a predetermined load in compression.

8. Rigidity control devices for use on structural braces of a building, each of which comprises a first member pivotally secured to a second member, said members having top and bottom surfaces, a flat plate type detent member rigidly secured to the bottom surface of said first member to extend beneath the bottom surface of said second member, an L-shaped second detent member having first and second legs, with the outer end of said first leg being hinged to said first detent whereby said second leg is permitted to pivot into and out of engagement with the top surface of said second member, pivot drive means to pivot said second leg, computer means, seismic detection means adapted to transmit signal to said computer means, said computer being adapted to selectively control said pivot drive means responsive to signals received from said seismic detection means, whereby selective actuation of said pivot drive means is adapted to vary the rigidity of said building and to change the natural vibration of said building.

9. The device of claim 8, including a second L-shaped detent member opposed to said first L-shaped detent member and pivotally secured to said first detent member to sandwich said second member between said L-shaped detent members and drive means adapted to pivot said L-shaped detents into and out of restraining engagement with said second member.

10. Rigidity control devices for use between structural members of a building, each of which comprises a first member pivotally secured to a second member, a detent member rigidly secured to said first member adapted to overlap said second member to delimit pivotal movement of said members, pressure pad means pivotally secured to said detent member, and actuating means secured to said second member adapted to selectively pivot said pivotal restraining pressure pad means into and out of pressure engagement with said second member.

11. The rigidity control device of claim 10, wherein electric servo motor means are adapted to selectively pivot said pressure pad means into and out of pressure engagement with said second members.

12. The device of claim 10, wherein said actuating means are electromagnetic means and are secured to opposite sides of said second member, and said pressure pad means are secured on opposite sides of said second member to sandwich said second member therebetween.

13. The device of claim 12, wherein said electromagnetic means are interposed between said pressure pad means and said second member, whereby said pressure pad means are selectively pivotable into and out of pressure engagement with said electromagnetic means.

* * * * *